US012497677B2

(12) United States Patent
Ishikawa

(10) Patent No.: US 12,497,677 B2
(45) Date of Patent: Dec. 16, 2025

(54) HIGH STRENGTH STEEL SHEET

(71) Applicant: NIPPON STEEL CORPORATION, Tokyo (JP)

(72) Inventor: Kyohei Ishikawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 100 days.

(21) Appl. No.: 18/568,329

(22) PCT Filed: Jul. 12, 2022

(86) PCT No.: PCT/JP2022/027462
§ 371 (c)(1),
(2) Date: Dec. 8, 2023

(87) PCT Pub. No.: WO2023/013372
PCT Pub. Date: Feb. 9, 2023

(65) Prior Publication Data

US 2024/0287663 A1 Aug. 29, 2024

(30) Foreign Application Priority Data

Aug. 2, 2021 (JP) ..... 2021-126979

(51) Int. Cl.

| | |
|---|---|
| ***C22C 38/54*** | (2006.01) |
| ***C21D 1/18*** | (2006.01) |
| ***C21D 6/00*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/16*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/34*** | (2006.01) |
| ***C22C 38/38*** | (2006.01) |
| ***C22C 38/42*** | (2006.01) |

(Continued)

(52) U.S. Cl.

CPC ..... *C22C 38/54* (2013.01); *C21D 1/18* (2013.01); *C21D 6/002* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0257* (2013.01); *C21D 8/0263* (2013.01); *C21D 8/0278* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C22C 38/22* (2013.01); *C22C 38/24* (2013.01); *C22C 38/26* (2013.01); *C22C 38/28* (2013.01); *C22C 38/32* (2013.01); *C22C 38/34* (2013.01); *C22C 38/38* (2013.01); *C22C 38/42* (2013.01); *C22C 38/44* (2013.01); *C22C 38/48* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search

CPC ..... C22C 38/001; C22C 38/002; C22C 38/02; C22C 38/005; C22C 38/04; C22C 38/06; C22C 38/12; C22C 38/14; C22C 38/16; C22C 38/22; C22C 38/24; C22C 38/26; C22C 38/28; C22C 38/32; C22C 38/34; C22C 38/38; C22C 38/42; C22C 38/44; C22C 38/48; C21D 2211/001; C21D 2211/002; C21D 2211/005; C21D 2211/008; C21D 2211/009

USPC ..... 428/632

See application file for complete search history.

(56) References Cited

U.S. PATENT DOCUMENTS

| | | | |
|---|---|---|---|
| 2016/0160335 | A1 | 6/2016 | Ikeda |
| 2017/0088914 | A1 | 3/2017 | Ikeda et al. |
| 2017/0369965 | A1 | 12/2017 | Ikeda et al. |

(Continued)

FOREIGN PATENT DOCUMENTS

| | | | |
|---|---|---|---|
| JP | 2014-227583 | A | 12/2014 |
| WO | WO 2015/005191 | A1 | 1/2015 |

(Continued)

*Primary Examiner* — Katherine A Christy

(74) *Attorney, Agent, or Firm* — Birch, Stewart, Kolasch & Birch, LLP

(57) ABSTRACT

A high strength steel sheet including a sheet thickness center part and a surface layer soft part formed at one side or both sides of the sheet thickness center part, wherein the sheet thickness center part has a predetermined chemical composition and has a microstructure comprising tempered martensite: 85% or more, the surface layer soft part has a thickness of more than 10 μm to 5.0% or less of the sheet thickness, a microstructure comprising ferrite: 80% or more, and an internal oxide layer having a thickness of 3 μm or more from the surface, an average Vickers hardness (Hc) of the sheet thickness center part and an average Vickers hardness (Hs) of the surface layer soft part satisfy Hs/Hc≤0.50, and a void area ratio in a region from the surface down to a 10 μm depth position is 3.0% or less.

4 Claims, No Drawings

(51) Int. Cl.
*C22C 38/44* (2006.01)
*C22C 38/48* (2006.01)

(56) References Cited

U.S. PATENT DOCUMENTS

| | | | |
|---|---|---|---|
| 2018/0002799 | A1 | 1/2018 | Futamura et al. |
| 2018/0010207 | A1 | 1/2018 | Futamura et al. |
| 2018/0010226 | A1 | 1/2018 | Ikeda et al. |
| 2018/0010227 | A1 | 1/2018 | Ikeda et al. |
| 2020/0232060 | A1 | 7/2020 | Nakano et al. |
| 2022/0063245 | A1 | 3/2022 | Nakano et al. |

FOREIGN PATENT DOCUMENTS

| | | | |
|---|---|---|---|
| WO | WO 2015/146692 | A1 | 10/2015 |
| WO | WO 2016/111271 | A1 | 7/2016 |
| WO | WO 2016/111272 | A1 | 7/2016 |
| WO | WO 2016/111273 | A1 | 7/2016 |
| WO | WO 2016/111274 | A1 | 7/2016 |
| WO | WO 2016/111275 | A1 | 7/2016 |
| WO | WO 2018/151331 | A1 | 8/2018 |
| WO | WO 2020/196060 | A1 | 10/2020 |

HIGH STRENGTH STEEL SHEET

FIELD

The present invention relates to a high strength steel sheet.

BACKGROUND

If making a steel sheet high in strength, the workability falls, and therefore it is generally difficult to achieve both strength and workability in a steel sheet. For example, the booms in cranes for construction machinery are tending to become longer along with the increasingly higher stories of buildings in recent years. Therefore, lighter weight and higher strength are being sought. Further, if applying steel sheet to members such as booms, bending work is involved, and therefore the need for a high strength steel sheet excellent in bendability is rising.

In the automobile industry as well, lighter weight of car bodies is being sought from the viewpoint of improvement of fuel efficiency. To achieve both lighter weight of car bodies and collision safety, making the steel sheet used high in strength is one effective method. Work is underway on developing a high strength steel sheet from such a background. In general, in a high strength steel sheet, compared with a mild steel sheet, the bendability and other formability fall. Sometimes the shaping methods used for the mild steel sheet cannot be applied. Therefore, in the field of a steel sheet for automobile use as well, there is a high need for a high strength steel sheet excellent in bendability.

PTL 1 describes a high strength steel sheet comprising a sheet thickness center part and a surface layer soft part formed at one side or both sides of the sheet thickness center part, wherein at a cross-section of the high strength steel sheet, metal structures of the sheet thickness center part comprise, by area ratio, tempered martensite: 85% or more, etc., metal structures of the surface layer soft part comprise, by area ratio, ferrite: 65% or more, pearlite: 5% or more and less than 20%, etc., an average distance between pearlite and pearlite at the surface layer soft part is 3 μm or more, a Vickers hardness (Hc) of the sheet thickness center part and a Vickers hardness (Hs) of the surface layer soft part satisfy $0.50 \leq Hs/Hc \leq 0.75$. Further, PTL 1 describes that the bending load and bendability of the steel sheet can be simultaneously raised by distributing pearlite as hard structures in the surface layer soft part.

PTL 2 describes a high strength steel sheet having a tensile strength of 800 MPa or more comprising a sheet thickness center part and a surface layer soft part arranged at one side or both sides of the sheet thickness center part, wherein each surface layer soft part has a thickness of more than 10 μm and 30% or less of the sheet thickness, the surface layer soft part has an average Vickers hardness of 0.60 time or less the average Vickers hardness of the sheet thickness ½ position, and the surface layer soft part has a nano-hardness standard deviation of 0.8 or less. Further, PTL 2 teaches that the bendability is remarkably improved by suppressing variations in hardness of the surface layer soft part in addition to having such a surface layer soft part.

PTL 3 describes a high strength hot rolled steel sheet having a predetermined chemical composition and having a microstructure in which 90% or more of the structures is martensite and an average aspect ratio of prior austenite grains from the surface layer in the cross-section in the rolling direction down to ⅛ of the sheet thickness is 3 or more and 20 or less. Further, PTL 3 describes that, according to the above constitution, it is possible to provide a high strength hot rolled steel sheet excellent in bendability and wear resistance and having a yield strength of 950 MPa or more.

Each of PTLs 4 to 10 describes a high-strength plated steel sheet having a hot-dip galvanized layer or a hot-dip galvannealed layer on a surface of a base steel sheet, wherein the high-strength plated steel sheet sequentially has, from an interface of the base steel sheet and the plated layer, towards the base steel sheet, an internal oxide layer comprising at least one oxide selected from the group consisting of Si and Mn; a soft layer including the internal oxide layer and having a Vickers hardness of 90% or less of a Vickers hardness at a portion t/4 of the base steel sheet, where t is a sheet thickness of the base steel sheet; and a predetermined hard layer, wherein the high-strength plated steel sheet satisfies an average depth D of the soft layer being 20 μm or greater; and an average depth d of the internal oxide layer being 4 μm or greater and smaller than the D; and a tensile strength being 980 MPa or higher. Further, PTLs 4 to 10 teach that by controlling the average depth d of the internal oxide layer to a thick 4 μm or greater to make use of the internal oxide layer as a hydrogen trap site, it is possible to effectively suppress hydrogen embrittlement, and that by suitably controlling the relationship between the average depth d of the internal oxide layer and the average depth D of the soft layer including the region of the internal oxide layer, the bendability in particular is raised.

CITATIONS LIST

Patent Literature

[PTL 1] WO2020/196060
[PTL 2] WO2018/151331
[PTL 3] Japanese Unexamined Patent Publication No. 2014-227583
[PTL 4] WO2016/111271
[PTL 5] WO2016/111272
[PTL 6] WO2016/111273
[PTL 7] WO2016/111274
[PTL 8] WO2016/111275
[PTL 9] WO2015/146692
[PTL 10] WO2015/005191

SUMMARY

Technical Problem

As proposed in the prior art, a soft layer can be provided at the surface of a steel sheet so as to improve the bendability. On the other hand, by placing a soft layer at the surface of a steel sheet, in general the surface hardness falls, and therefore sometimes the appearance is impaired due to the formation of defects, the wear resistance falls, etc. In relation to this, PTL 3 teaches that by making the average aspect ratio of prior austenite grains from the surface layer down to ⅛ of the sheet thickness 3 or more and 20 or less, the surface hardness is improved and the steel sheet excellent in bendability is obtained. However, PTL 3 does not necessarily sufficiently study the control of the microstructure at the surface layer part other than the average aspect ratio of the prior austenite grains. Therefore, in the invention described in PTL 3, there was still room for improvement in relation to enhancing the bendability and the surface hardness.

Therefore, the present invention has as its object the provision of a high strength steel sheet having improved bendability and able to suppress formation of defects.

Solution to Problem

The inventor discovered that to achieve the above object, in a high strength steel sheet having a 1250 MPa or more tensile strength, it is possible to provide a surface layer soft part having an average Vickers hardness of a predetermined ratio with respect to the average Vickers hardness of the sheet thickness center part so as to improve the bendability and possible to form an internal oxide layer having a predetermined thickness at the outermost surface layer part of the surface layer soft part and further control the voids formed near the surface layer to within a suitable range so as to raise the surface hardness and suppress the formation of defects at the steel sheet surface, and thereby completed the present invention.

The present invention able to achieve the above object is as follows:

(1) A high strength steel sheet comprising a sheet thickness center part and a surface layer soft part formed at one side or both sides of the sheet thickness center part, wherein the sheet thickness center part has a chemical composition comprising, by mass %, C: 0.10 to 0.30%,
Si: 0.01 to 2.50%,
Mn: 0.10 to 10.00%,
P: 0.100% or less,
S: 0.0500% or less,
Al: 0 to 1.50%,
N: 0.0100% or less,
O: 0.0060% or less,
Cr: 0 to 2.00%,
Mo: 0 to 1.00%,
B: 0 to 0.0100%,
Ti: 0 to 0.30%,
Nb: 0 to 0.30%,
V: 0 to 0.50%,
Cu: 0 to 1.00%,
Ni: 0 to 1.00%,
Ca: 0 to 0.040%,
Mg: 0 to 0.040%,
REM: 0 to 0.040%, and a remainder comprising Fe and impurities, and satisfying $1.50 \leq [Si]+[Mn]+[Al]+[Cr] \leq 20.00$, wherein [Si], [Mn], [Al], and [Cr] are contents (mass %) of the elements, and has a microstructure comprising, by area ratio, tempered martensite: 85% or more, the surface layer soft part has a thickness of more than 10 μm to 5.0% or less of the sheet thickness, a microstructure comprising, by area ratio, ferrite: 80% or more, and an internal oxide layer having a thickness of 3 μm or more from the surface of the high strength steel sheet, an average Vickers hardness (Hc) of the sheet thickness center part and an average Vickers hardness (Hs) of the surface layer soft part satisfy $Hs/Hc \leq 0.50$, and a void area ratio in a region from the surface of the high strength steel sheet down to a 10 μm depth position is 3.0% or less.

(2) The high strength steel sheet according to the above (1), wherein the sheet thickness center part has a microstructure consisting of, by area ratio, tempered martensite: 85% or more, at least one of ferrite, bainite, pearlite, and retained austenite: than 15% in total, and as-quenched martensite: less than 5%.

(3) The high strength steel sheet according to the above (1) or (2), wherein the surface layer soft part has a microstructure consisting of, by area ratio, ferrite: 80% or more, at least one of tempered martensite, bainite, and retained austenite: less than 20% in total, pearlite: less than 5%, and as-quenched martensite: less than 5%.

(4) The high strength steel sheet according to any one of the above (1) to (3), wherein the high strength steel sheet further comprises a hot dip galvanized layer, hot dip galvannealed layer, or electrogalvanized layer on the surface of the surface layer soft part.

Advantageous Effects of Invention

According to the present invention, it is possible to provide a high strength steel sheet having improved bendability and able to suppress formation of defects. Such a high strength steel sheet has a high resistance to formation of defects and enables the appearance properties to be maintained well, and therefore for example is extremely useful for use as framework members such as pillar members in which high strength and also design sense and appearance are sought—called "quasi outer panel parts" of automobiles. Further, such a high strength steel sheet is high in surface hardness and therefore excellent in wear resistance as well. Therefore, for example, the high strength steel sheet is extremely suitable in applications such as booms of cranes for construction machinery in which not only high strength but also high bendability and wear resistance are sought.

DESCRIPTION OF EMBODIMENTS

<High Strength Steel Sheet>

The high strength steel sheet according to an embodiment of the present invention is characterized in that the high strength steel sheet comprises a sheet thickness center part and a surface layer soft part formed at one side or both sides of the sheet thickness center part, wherein the sheet thickness center part has a chemical composition comprising, by mass %, C: 0.10 to 0.30%,
Si: 0.01 to 2.50%,
Mn: 0.10 to 10.00%,
P: 0.100% or less,
S: 0.0500% or less,
Al: 0 to 1.50%,
N: 0.0100% or less,
O: 0.0060% or less,
Cr: 0 to 2.00%,
Mo: 0 to 1.00%,
B: 0 to 0.0100%,
Ti: 0 to 0.30%,
Nb: 0 to 0.30%,
V: 0 to 0.50%,
Cu: 0 to 1.00%,
Ni: 0 to 1.00%,
Ca: 0 to 0.040%, Mg: 0 to 0.040%, REM: 0 to 0.040%, and a remainder comprising Fe and impurities, and satisfying $1.50 \leq [Si]+[Mn]+[Al]+[Cr] \leq 20.00$, wherein [Si], [Mn], [Al], and [Cr] are contents (mass %) of the elements, and has a microstructure comprising, by area ratio, tempered martensite: 85% or more, the surface layer soft part has a thickness of more than 10 μm to 5.0% or less of the sheet thickness, a microstructure comprising, by area ratio, ferrite: 80% or more, and an internal oxide layer having a thickness of 3 μm or more from the surface of the high strength steel sheet, an average Vickers hardness (Hc) of the sheet thickness center part and an average Vickers hardness (Hs) of the surface layer soft part satisfy $Hs/Hc \leq 0.50$, and a void area ratio in a region from the surface of the high strength steel sheet down to a 10 μm depth position is 3.0% or less.

As explained earlier, by providing a soft layer at the surface of a steel sheet, it is possible to improve the bendability, but on the other hand, due to such a surface layer soft part, in general, the surface hardness falls, and therefore sometimes deterioration of the appearance due to formation of defects, a drop in wear resistance, etc., are invited. Therefore, the inventor studied a high strength steel sheet having a 1250 MPa or more tensile strength focusing on not only the surface layer soft part provided at one or both sides of the sheet thickness center part but also the microstructure at the outermost surface layer part or vicinity of the surface layer at the surface layer soft part. More specifically, the inventor first discovered that by making the microstructure of a surface layer soft part having a predetermined thickness one containing, by area ratio, 80% or more ferrite while controlling the average Vickers hardness (Hs) of the surface layer soft part and the average Vickers hardness (Hc) of the sheet thickness center part so that they satisfy the formula of $Hs/Hc \leq 0.50$, it is possible to remarkably improve the bendability of the high strength steel sheet. Further, the inventor took note of and further studied the internal oxide layer formed at the outermost surface layer part of the steel sheet by relatively easily oxidizable constituents (for example, Si, Al, etc.) in the steel sheet bonding with oxygen in an annealing atmosphere in annealing treatment performed after rolling (typically hot rolling and cold rolling) and the voids (cavities) which are sometimes formed near the surface layer in association with other production conditions. As a result, the inventor discovered that by making the internal oxide layer including oxides of Si, Al, etc., a thickness of 3 μm or more from the steel sheet surface while controlling the area ratio of voids formed in the vicinity of the surface layer, more specifically the void area ratio in the region from the steel sheet surface to a 10 μm depth position, to 3.0% or less, it is possible to greatly raise the surface hardness of the steel sheet and also remarkably suppress the formation of defects at the steel sheet surface.

While not intending to be bound to any specific theory, it is believed that the particles of internal oxides present inside the internal oxide layer become obstacles to dislocation inside the steel whereby dislocation motion is pinned and the surface hardness of the steel sheet rises. Explained more specifically, "dislocation" generally refers to streak like crystal defects, but deformation of steel generally occurs due to iron atoms near the dislocations contained in the steel being repositioned due to external force, etc., and thereby the positions of the dislocations moving. Here, if an internal oxide layer having a predetermined thickness, specifically a thickness of 3 μm or more from the surface of the steel sheet (if there is a plated layer present at the surface of the steel sheet, the interface of the plated layer and the steel sheet), is formed at the surface layer part of the steel sheet, since numerous fine oxide particles will be present scattered inside it, such internal oxide particles will act as obstacles causing motion of the dislocations to be blocked. As a result, it is believed that the surface hardness of the steel sheet rises. On the other hand, if just forming an internal oxide layer, the surface hardness rises, but sometimes cracking or peeling or other formation of defects cannot be reliably prevented.

This time, the inventor conducted further studied and discovered that if there is a certain amount or more of voids (cavities) near the surface layer, if the steel sheet is subjected to some sort of external force, the voids will sometimes become starting points for peeling, cracking, or other defects and discovered that by controlling the void area ratio in the region from the steel sheet surface down to a 10 μm depth position to 3.0% or less, it is possible to reliably suppress such formation of defects. Therefore, the high strength steel sheet according to an embodiment of the present invention can, for example, be used well for the high strength steel sheet for automobile use where excellent bendability and high resistance to defects are sought, members for construction machinery, for example, booms of cranes, where excellent bendability and wear resistance are demanded, and other applications. Below, the high strength steel sheet according to an embodiment of the present invention will be explained in further detail.

[Chemical Composition of Sheet Thickness Center Part]

First, the chemical composition of the sheet thickness center part will be explained. At the sheet thickness center part, the chemical composition near the boundary with the surface layer soft part will sometimes differ from a position sufficiently far from the boundary due to diffusion of alloy elements with the surface layer soft part. In such a case, below, the "chemical composition of the sheet thickness center part" will mean the chemical composition measured near the sheet thickness ½ position. Further, in the following explanation, the "%" units of content of the elements mean "mass %" unless otherwise indicated. Further, in this Description, the "to" showing a range of numerical values, unless otherwise indicated, is used in the sense including the numerical values before and after it as the upper limit value and lower limit value.

[C: 0.10 to 0.30%]

Carbon (C) is an element effective for securing a predetermined amount of tempered martensite and raising the strength of steel sheet. To sufficiently obtain these effects, the C content is 0.10% or more. The C content may also be 0.12% or more, 0.14% or more, 0.16% or more, or 0.18% or more. On the other hand, if excessively containing C, the ductility and/or bendability sometimes falls. Therefore, the C content is 0.30% or less. The C content may also be 0.28% or less, 0.26% or less, 0.24% or less, or 0.22% or less.

[Si: 0.01 to 2.50%]

Silicon (Si) is an element effective for securing quenchability. Further, Si is also an element suppressing alloying with Al. To sufficiently obtain these effects, the Si content is 0.01% or more. The Si content may also be 0.05% or more, 0.10% or more, 0.15% or more, or 0.30% or more. On the other hand, if excessively containing Si, the sheet thickness center part becomes brittle and sometimes the bendability drops. Therefore, the Si content is 2.50%. The Si content may also be 2.20% or less, 2.10% or less, 2.00% or less, 1.80% or less, or 1.50% or less.

[Mn: 0.10 to 10.00%]

Manganese (Mn) is an element acting as a deoxidizer. Further, Mn is an element effective for raising the quenchability. To sufficiently obtain these effects, the Mn content is 0.10% or more. The Mn content may also be 0.20% or more, 0.50% or more, 0.80% or more, or 1.00% or more. On the other hand, if excessively containing Mn, coarse Mn oxides are formed in the steel and sometimes the elongation of the steel sheet falls. Therefore, the Mn content is 10.00% or less. The Mn content may also be 9.00% or less, 8.00% or less, 6.00% or less, or 5.00% or less.

[P: 0.100% or Less]

Phosphorus (P) is an element unavoidably entering in the production process. The P content may also be 0%. However, to reduce the P content to less than 0.00010%, time is required in the refining and a drop in productivity is invited. Therefore, the P content may be 0.0001% or more, 0.0005% or more, 0.001% or more, or 0.005% or more. On the other hand, if excessively containing P, it sometimes segregates at the sheet thickness center part of the steel sheet causing the toughness to drop. Therefore, the P content is 0.100% or less. The P content may also be 0.080% or less, 0.060% or less, 0.040% or less, or 0.020% or less.

[S: 0.0500% or Less]

Sulfur (S) is an element unavoidably entering in the production process. The S content may also be 0%. However, to reduce the S content to less than 0.0001%, time is required in the refining and a drop in productivity is invited. Therefore, the S content may be 0.0001% or more, 0.0005% or more, or 0.010% or more. On the other hand, if excessively containing S, it sometimes forms coarse MnS and the toughness of the steel sheet drops. Therefore, the S content is 0.0500% or less. The S content may also be 0.0400% or less, 0.0300% or less, 0.0200% or less, or 0.0100% or less.

[Al: 0 to 1.50%]

Aluminum (Al) is an element acting as a deoxidizer of steel and stabilizes the ferrite. The Al content may also be 0%, but to obtain such an effect, the Al content is preferably 0.0010% or more. The Al content may also be 0.01% or more, 0.02% or more, or 0.03% or more. On the other hand, if excessively containing Al, coarse Al oxides are formed and sometimes the elongation of the steel sheet falls and/or sometimes tempered martensite cannot be sufficiently produced. Therefore, the Al content is 1.50% or less. The Al content may also be 1.40% or less, 1.30% or less, 1.00% or less, or 0.80% or less.

[N: 0.0100% or Less]

Nitrogen (N) is an element unavoidably entering in the production process. The N content may also be 0%. However, to reduce the N content to less than 0.0001%, time is required in the refining and a drop in productivity is invited. Therefore, the N content may be 0.0001% or more, 0.0005% or more, or 0.0010% or more. On the other hand, if excessively containing N, coarse nitrides are formed and sometimes the bendability and/or toughness of the steel sheet is made to fall. Therefore, the N content is 0.0100% or less. The N content may also be 0.0080% or less, 0.0060% or less, or 0.0050% or less.

[O: 0.0060% or Less]

Oxygen (O) is an element unavoidably entering in the production process. The O content may also be 0%. However, to reduce the O content to less than 0.0001%, time is required in the refining and a drop in productivity is invited. Therefore, the O content may be 0.0001% or more, 0.0005% or more, or 0.0010% or more. On the other hand, if excessively including 0, coarse inclusions are formed and sometimes the toughness of the steel sheet is made to fall. Therefore, the O content is 0.0060% or less. The O content may also be 0.0050% or less, 0.0045% or less, or 0.0040% or less.

The basic chemical composition of the sheet thickness center part according to an embodiment of the present invention is as explained above. Further, the sheet thickness center part may, in accordance with need, contain at least one among the following optional elements instead of part of the remainder of Fe. For example, the sheet thickness center part may contain at least one selected from the group consisting of Cr: 0 to 2.00%, Mo: 0 to 1.00%, and B: 0 to 0.0100%. Further, the sheet thickness center part may contain at least one selected from the group consisting of Ti: 0 to 0.30%, Nb: 0 to 0.30%, and V: 0 to 0.50%. Further, the sheet thickness center part may contain at least one selected from the group consisting of Cu: 0 to 1.00% and Ni: 0 to 1.00%. Further, the sheet thickness center part may contain at least one selected from the group consisting of Ca: 0 to 0.040%, Mg: 0 to 0.040%, and REM: 0 to 0.040%. Below, these optional elements will be explained in detail.

[Cr: 0 to 2.00%]

Chromium (Cr) is an element effective for raising the quenchability and making steel sheet high in strength. The Cr content may also be 0%, but to obtain such an effect, the Cr content is preferably 0.001% or more. The Cr content may also be 0.01% or more, 0.10% or more, or 0.20% or more. On the other hand, if excessively including Cr, the Cr segregates at the sheet thickness center part of the steel sheet whereby coarse Cr carbides are formed and sometimes the elongation of the steel sheet is made to drop. Therefore, the Cr content is preferably 2.00% or less. The Cr content may also be 1.80% or less, 1.00% or less, or 0.50% or less.

[Mo: 0 to 1.00%]

Molybdenum (Mo), in the same way as Cr, is an element effective for making steel sheet high in strength. The Mo content may also be 0%, but to obtain such an effect, the Mo content is preferably 0.001% or more. The Mo content may also be 0.01% or more, 0.05% or more, or 0.10% or more. On the other hand, if excessively containing Mo, coarse Mo carbides are formed and sometimes the cold workability of the steel sheet is made to drop. Therefore, the Mo content is preferably 1.00% or less. The Mo content may also be 0.90% or less, 0.80% or less, or 0.60% or less.

[B: 0 to 0.0100%]

Boron (B) is an element effective for making steel sheet high in strength. The B content may also be 0%, but to obtain such an effect, the B content is preferably 0.0001% or more. The B content may also be 0.0005% or more, 0.0010% or more, or 0.0015% or more. On the other hand, if excessively containing B, the toughness and or weldability sometimes fall. Therefore, the B content is preferably 0.0100% or less. The B content may also be 0.0080% or less, 0.0060% or less, or 0.0040% or less.

[Ti: 0 to 0.30%]

Titanium (Ti) is an element effective for control of the form of carbides and is also an element prompting an increase of strength of ferrite. The Ti content may also be 0%, but to obtain these effects, the Ti content is preferably 0.001% or more. The Ti content may also be 0.005% or more, 0.010% or more, or 0.02% or more. On the other hand, if excessively containing Ti, coarse oxides or nitrides are formed in the steel and sometimes the workability of the steel sheet is lowered. Therefore, the Ti content is preferably 0.30% or less. The Ti content is 0.20% or less, 0.15% or less, or 0.10% or less.

[Nb: 0 to 0.30%]

Niobium (Nb), in the same way as Ti, is an element effective for control of the form of carbides and also an element refining the microstructure by the pinning effect to contribute to improvement of the toughness of the steel sheet. The Nb content may also be 0%, but to obtain these effects, the Nb content is preferably 0.001% or more. The Nb content may also be 0.005% or more, 0.01% or more, or 0.02% or more. On the other hand, if excessively containing Nb, a large number of fine, hard Nb carbides precipitate, the ductility falls along with the rise in strength of the steel sheet, and sometimes the workability of the steel sheet is made to fall. Therefore, the Nb content is preferably 0.30% or less. The Nb content may also be 0.20% or less, 0.15% or less, or 0.10% or less.

[V: 0 to 0.50%]

Vanadium (V), in the same way as Ti and Nb, is an element effective for control of the form of carbides and also an element refining the microstructure by the pinning effect to contribute to improvement of the toughness of the steel sheet. The V content may also be 0%, but to obtain these effects, the V content is preferably 0.001% or more. The V content may also be 0.005% or more, 0.01% or more, or 0.02% or more. On the other hand, if excessively containing V, a large number of fine V carbides precipitate, the ductility falls along with the rise in strength of the steel sheet, and sometimes the workability of the steel sheet is made to fall. Therefore, the V content is preferably 0.50% or less. The V content may also be 0.30% or less, 0.20% or less, or 0.10% or less.

[Cu: 0 to 1.00%]

Copper (Cu) is an element effective for improvement of the strength of steel sheet. The Cu content may also be 0%, but to obtain such an effect, the Cu content is preferably 0.001% or more. The Cu content may also be 0.01% or more, 0.03% or more, or 0.05% or more. On the other hand, if excessively containing Cu, red hot embrittlement is invited and sometimes the productivity in hot rolling falls. Therefore, the Cu content is preferably 1.00% or less. The Cu content may also be 0.80% or less, 0.60% or less, or 0.40% or less.

[Ni: 0 to 1.00%]

Nickel (Ni), in the same way as Cu, is an element effective for raising the strength of steel sheet. The Ni content may also be 0%, but to obtain such an effect, the Ni content is preferably 0.001% or more. The Ni content may also be 0.01% or more, 0.03% or more, or 0.05% or more. On the other hand, if excessively containing Ni, the ductility falls and sometimes the workability of the steel sheet is made to fall. Therefore, the Ni content is preferably 1.00% or less. The Ni content may also be 0.80% or less, 0.60% or less, or 0.40% or less.

[Ca: 0 to 0.040%]

Calcium (Ca) is an element able to control the form of sulfides by trace addition. The Ca content may also be 0%, but to obtain such an effect, the Ca content is preferably 0.00010% or more. The Ca content may also be 0.0005% or more, 0.001% or more, or 0.005% or more. On the other hand, if excessively containing Ca, coarse Ca oxides are formed and sometimes the workability of the steel sheet is made to fall. Therefore, the Ca content is preferably 0.040% or less. The Ca content may also be 0.030% or less, 0.020% or less, or 0.015% or less.

[Mg: 0 to 0.040%]

Magnesium (Mg), in the same way as Ca, is an element enabling control of the form of the sulfides by trace addition. The Mg content may also be 0%, but to obtain such an effect, the Mg content is preferably 0.0001% or more. The Mg content may also be 0.0005% or more, 0.001% or more, or 0.005% or more. On the other hand, if excessively containing Mg, coarse inclusions are formed and sometimes the workability of the steel sheet is made to fall. Therefore, the Mg content is preferably 0.040% or less. The Mg content may also be 0.030% or less, 0.020% or less, or 0.015% or less.

[REM: 0 to 0.040%]

Rare earth metals (REM), in the same way as Ca and Mg, are elements enabling control of the form of the sulfides by trace addition. The REM content may also be 0%, but to obtain such an effect, the REM content is preferably 0.0001% or more. The REM content may also be 0.0005% or more, 0.001% or more, or 0.005% or more. On the other hand, if excessively containing REM, coarse inclusions are formed and sometimes the workability of the steel sheet is made to fall. Therefore, the REM content is preferably 0.040% or less. The REM content may also be 0.030% or less, 0.020% or less, or 0.015% or less. The "REM" in this Description is a generic term for the 17 elements of atomic number 21 scandium (Sc), atomic number 39 yttrium (Y), and the lanthanoids of atomic number 57 lanthanum (La) to atomic number 71 lutetium (Lu). The REM content is the total content of these elements.

(Other)

Furthermore, the sheet thickness center part may intentionally or unavoidably contain the following elements. The effect of the present invention is not obstructed by these. These elements are W: 0 to 0.10%, Ta: 0 to 0.10%, Co: 0 to 0.50%, Sn: 0 to 0.050%, Sb: 0 to 0.050%, As: 0 to 0.050%, and Zr: 0 to 0.050%. The contents of these elements may also be respectively 0.0001% or more or 0.0010% or more.

At the sheet thickness center part according to an embodiment of the present invention, the remainder other than the above elements consists of Fe and impurities. "Impurities" are constituents, etc., unavoidably entering due to various factors in the production process, such as the ore, scraps, and other such raw materials, when industrially producing a steel sheet or the sheet thickness center part thereof.

[1.50≤[Si]+[Mn]+[Al]+[Cr]≤20.00]

The chemical composition of the sheet thickness center part according to an embodiment of the present invention has to satisfy the following formula:

$$1.50 \leq [Si]+[Mn]+[Al]+[Cr] \leq 20.00$$

wherein [Si], [Mn], [Al], and [Cr] are the contents (mass %) of the elements.

As explained previously, in the high strength steel sheet according to an embodiment of the present invention, the internal oxides formed at the outermost surface layer part are extremely important in raising the surface hardness of the steel sheet. The internal oxide layer is formed at the outermost surface layer part of the steel sheet by the relatively easily oxidizing constituents in the steel sheet, for example, Si, Mn, Al, and Cr, bonding with the oxygen in the annealing atmosphere mainly at the time of annealing treatment after cold rolling. Therefore, to make the internal oxide layer a sufficient thickness for making the surface hardness of the steel sheet rise, specifically to make it form up to a 3 μm or more thickness from the steel sheet surface, these elements have to be included in the steel in a certain amount or more in total. The chemical composition of the sheet thickness center part according to an embodiment of the present invention is controlled so as to control the contents of the alloy elements to within the ranges explained previously while the total content of Si, Mn, Al, and Cr satisfies 1.50% or more, i.e., [Si]+[Mn]+[Al]+[Cr]≥1.50. By suitably combining the chemical composition of the sheet thickness center part and in particular the conditions of the annealing treatment, etc., it becomes possible to reliably form an internal oxide layer having a 3 μm or more thickness. As a result, a high surface hardness is achieved and the formation of defects at the steel sheet surface is suppressed and it becomes possible to achieve excellent wear resistance.

The total content of Si, Mn, Al, and Cr may be 1.60% or more, 1.70% or more, 1.80% or more, 1.90% or more, 2.00% or more, 2.20% or more, or 2.50% or more. On the other hand, if the total content of Si, Mn, Al, and Cr is too high, while not necessarily having a disadvantageous effect from the viewpoint of promotion of the formation of the internal oxides to make the surface hardness higher, the contents of the individual alloy elements become too high, and therefore sometimes the properties associated with them drop. Therefore, the total content of Si, Mn, Al, and Cr is 20.00% or less. For example, the total content of Si, Mn, Al, and Cr may also be 15.00% or less, 12.00% or less, 10.00% or less, 9.00% or less, 8.00% or less, or 7.00% or less.

[Microstructure of Sheet Thickness Center Part]

[Tempered Martensite: 85% or More]

The microstructure of the sheet thickness center part includes, by area ratio, 85% or more tempered martensite. Tempered martensite forms high strength and tough structures. In an embodiment according to the present invention, by having the predetermined chemical composition explained previously, in particular a 0.10% or more C content, and including tempered martensite at the sheet thickness center part in 85% or more, a high tensile strength, specifically a 1250 MPa or more tensile strength, can be reliably achieved. The area ratio of the tempered martensite may also be 86% or more, 88% or more, or 90% or more. The upper limit of the area ratio of the tempered martensite is not particularly limited and may be 100%. For example, the area ratio of the tempered martensite may also be 98% or less, 96% or less, or 94% or less.

[At Least One of Ferrite, Bainite, Pearlite, and Retained Austenite: Less than 15% in Total]

The microstructure of the sheet thickness center part may contain any other structures so long as satisfying the requirement of containing, by area ratio, 85% or more tempered martensite. While not particularly limited, for example, at the sheet thickness center part, the total of the area ratios of the at least one of ferrite, bainite, pearlite, and retained austenite preferably is less than 15%.

Ferrite forms soft structures, and therefore easily deforms and contributes to raising the ductility of a steel sheet. Therefore, from the viewpoint of raising the ductility of the steel sheet, the microstructure of the sheet thickness center part may contain ferrite. However, since the interfaces of hard structures of tempered martensite and soft structures of ferrite can become starting points of fracture, if excessively including ferrite, sometimes the hole expandability at the steel sheet is made to fall. Further, bainite is hard, and therefore contributes to raising the strength of a steel sheet. Therefore, from the viewpoint of raising the strength of the steel sheet, the microstructure of the sheet thickness center part may also contain bainite. However, if excessively including bainite, the strength of the steel sheet is raised, but sometimes the uniformity of the microstructure falls and the hole expandability at the steel sheet is made to drop. The bainite may be any of upper bainite having carbides between laths, lower bainite having carbides in laths, bainitic ferrite not having carbides, or granular bainitic ferrite where the lath boundaries of bainite have recovered and become unclear and may also be mixed structures of the same.

Pearlite forms hard structures of soft ferrite and hard cementite arranged in layers and structures contributing to raising the strength of a steel sheet. Therefore, from the viewpoint of raising the strength of the steel sheet, the microstructure of the sheet thickness center part may also contain pearlite. However, since the interface between soft ferrite and hard cementite can become starting points of fracture, if excessively containing pearlite, sometimes the hole expandability of the steel sheet is lowered. Further, retained austenite forms structures contributing to raising the ductility of a steel sheet by the work induced transformation (TRIP) effect. Therefore, from the viewpoint of raising the ductility of the steel sheet, the microstructure of the sheet thickness center part may contain retained austenite. On the other hand, since retained austenite transforms to as-quenched martensite by work induced transformation, if excessively containing retained austenite, sometimes the hole expandability at the steel sheet is made to drop.

By controlling the total of the area ratios of the at least one of ferrite, bainite, pearlite, and retained austenite to less than 15%, it is possible to reliably avoid the disadvantages of these structures being excessively contained, more specifically a drop in the hole expandability unrelated to the object of the present invention and, on the other hand, to sufficiently express the additional effects due to these structures. The total of the area ratios of the at least one of ferrite, bainite, pearlite, and retained austenite may also be 0%, but, for example, may also be 1% or more, 3% or more, 4% or more, or 5% or more. Further, the total of the area ratios of the at least one of ferrite, bainite, pearlite, and retained austenite may also be 14% or less, 12% or less, 11% or less, or 10% or less.

[As-Quenched Martensite: Less than 5%]

"As-quenched martensite" means martensite which is not tempered, i.e., martensite not containing carbides. As-quenched martensite forms extremely hard structures. Therefore, the area ratio of the as-quenched martensite may also be 0%, but from the viewpoint of raising the strength, may also be 1% or more or 2% or more. On the other hand, since as-quenched martensite also forms brittle structures, from the viewpoint of securing higher toughness, the area ratio of the as-quenched martensite is preferably less than 5%. The area ratio of the as-quenched martensite may also be 4% or less or 3% or less.

[Identification of Microstructure and Calculation of Area Ratios at Sheet Thickness Center Part]

[Tempered Martensite and Bainite]

At the sheet thickness center part, the microstructure is identified and the area ratios are calculated in the following way. First, a sample having a sheet thickness cross-section parallel to the rolling direction of the steel sheet is taken. That cross-section is made the examined surface. This examined surface was corroded by Nital. In the corroded examined surface, a 100 μm×100 μm region centered about the ¼ position of sheet thickness from the steel sheet surface is made the examined region. This examined region is examined using a field emission type scan electron microscope (FE-SEM) at 1000 to 50000×. The tempered martensite and bainite are identified in the following way from the position of cementite and the arrangement of cementite contained inside the microstructure in this examined region. In tempered martensite, there is cementite inside of the martensite laths, but there are two or more types of martensite laths and crystal orientations of the cementite. The cementite includes several variants, therefore the tempered martensite can be identified. The area ratio of the thus identified tempered martensite is calculated by the point counting method (based on ASTM E562). On the other hand, as the state of presence of bainite, in some cases the cementite or retained austenite is present at the interfaces of lath shaped bainitic ferrite and in some cases the cementite is present at the insides of the lath shaped bainitic ferrite. If the cementite or retained austenite is present at the interfaces of lath shaped bainitic ferrite, since the interfaces of the bainitic ferrite can be determined, the bainite can be identified. Further, if cementite is present at the insides of the lath shaped bainitic ferrite, since there is one type of relationship of crystal orientation of the bainitic ferrite and the cementite and there is a single variant of the cementite, the bainite can be identified. The area ratio of the identified bainite is calculated by the point counting method.

[Ferrite]

First, a sample having a sheet thickness cross-section parallel to the rolling direction of the steel sheet is taken. That cross-section is made the examined surface. In the examined surface, a 100 μm×100 μm region centered about the ¼ position of sheet thickness from the steel sheet surface is made the examined region. This examined region is examined using a scan electron microscope at 1000 to 50000× so as to thereby obtain an electron channeling contrast image. The electron channeling contrast image is a technique detecting the difference in crystal orientation inside the crystal grains as a difference in contrast. In the electron channeling contrast image, parts of uniform contrast are ferrite. The area ratio of the identified ferrite is calculated by the point counting method.

[Pearlite]

The examined region corroded by Nital explained in relation to the tempered martensite and bainite is examined by an optical microscope by 1000 to 50000×. In the examined image, dark contrast regions are identified as pearlite. The area ratio of the identified pearlite is calculated by the point counting method.

[Retained Austenite]

The volume ratio of the retained austenite is measured by X-ray diffraction. First, in the sample taken as explained above, the part from the surface of the steel sheet down to the ¼ position of the sheet thickness is removed by mechanical polishing and chemical polishing to expose the surface at the ¼ position of sheet thickness from the surface of the steel sheet. The exposed surface is irradiated by MoKα rays to find the integrated intensity ratio of the diffraction peaks of the (200) face and (211) face of the bcc phase and the (200) face, (220) face, and (311) face of the fcc phase. From the integrated intensity ratio of the diffraction peaks, the volume ratio of the retained austenite is calculated. As this method of calculation, a general five peak method is used. The calculated volume ratio of the retained austenite is determined as the area ratio of the retained austenite.

[As-Quenched Martensite]

First, an examined surface similar to the examined surface used for identification of ferrite is etched by a Lepera solution. A region similar to that for identification of ferrite is defined as the examined region. In the corrosion by the Lepera solution, the martensite and retained austenite are not corroded. For this reason, the examined region corroded by the Lepera solution is examined by FE-SEM and regions not corroded are identified as martensite and retained austenite. The total area ratio of the identified martensite and retained austenite is calculated by the point counting method. Next, the above determined area ratio of retained austenite is subtracted from the total area ratio to determine the area ratio of the as-quenched martensite.

[Surface Layer Soft Part]

The surface layer soft part formed at one side or both sides of the sheet thickness center part has a thickness of from more than 10 μm to 5.0% or less of the sheet thickness and has an average Vickers hardness (Hs) of 0.50 time or less of the average Vickers hardness (Hc) of the sheet thickness center part (i.e., Hs/Hc≤0.50). By having a more than 10 μm thickness and satisfying Hs/Hc≤0.50, the effect of provision of the surface layer soft part at one side or both sides of the steel sheet can be reliably manifested and, as a result, the bendability of the steel sheet can be remarkably raised. For example, to further heighten the effect of raising the bendability, the thickness of the surface layer soft part may be 15 μm or more, 20 μm or more, 25 μm or more, 30 m or more, 35 μm or more, or 40 μm or more. Further, the thickness of the surface layer soft part may also be 4.5% or less, 4.0% or less, 3.5% or less, 3.0% or less, or 2.5% or less of the sheet thickness. If surface layer soft parts are formed at both sides of the sheet thickness center part, the thickness of the surface layer soft part at one side and the thickness of the surface layer soft part at the other side may be the same or may be different. Similarly, to further heighten the effect of raising the bendability, the ratio (Hs/Hc) of average Vickers hardness (Hs) of the surface layer soft part and the average Vickers hardness (Hc) of the sheet thickness center part may be less than 0.50, 0.49 or less, 0.48 or less, 0.47 or less, 0.46 or less, or 0.45 or less. The lower limit of Hs/Hc is not particularly limited, but, for example, Hs/Hc may be 0.20 or more, 0.25 or more, or 0.30 or more. If surface layer soft parts are formed at the two sides of the sheet thickness center part, the Hs/Hc relating to the surface layer soft part at one side and the Hs/Hc relating to the surface layer soft part at the other side may be the same or may be different.

In the present invention, the "thickness of the surface layer soft part", the "average Vickers hardness (Hc) of the sheet thickness center part", and the "average Vickers hardness (Hs) of the surface layer soft part" are determined in the following way. The Vickers hardness test is performed based on JIS Z 2244-1: 2020. First, the Vickers hardness at the sheet thickness ½ position of the steel sheet is measured by a pressing load 10 g weight, then on a line from that position in a direction vertical to the sheet thickness and parallel to the rolling direction, similarly a total of three points or more, for example five points or 10 points, are measured for Vickers hardness by a pressing load 10 g weight. The average value of these is determined as the average Vickers hardness (Hc) of the sheet thickness center part. The distance between the measurement points is preferably a distance of 4 times or more of the indentation. A "distance of 4 times or more of the indentation" means a distance of 4 times or more of the length of a diagonal at a rectangular opening of an indentation caused by a diamond indenter when measuring the Vickers hardness. Next, a glow discharge optical emission spectroscope (GDS) is used to measure the C concentration in the depth direction from the surface. The region over which the C concentration gradually increases from the surface down to ½ of the average C concentration of the base phase (C content of sheet thickness center part) is defined as the surface layer soft part. The thickness (m) of the surface layer soft part and its ratio in the sheet thickness (%) are determined. In the thus determined surface layer soft part, the Vickers hardnesses of 10 points are randomly measured by a pressing load 10 g weight, and the average value of these is calculated to determine the average Vickers hardness (Hs) of the surface layer soft part.

If surface layer soft parts are formed at the two sides of the sheet thickness center part, measurement is performed in the same way as explained above to determine the thickness and average Vickers hardness (Hs) of the surface layer soft part at the other side.

[Microstructure of Surface Layer Soft Part]

[Ferrite: 80% or More]

The microstructure of the surface layer soft part includes, by area ratio, 80% or more ferrite. Ferrite forms soft structures, and therefore easily deforms. For this reason, by including ferrite in 80% or more at the surface layer soft part, it is possible to achieve a high bendability. The area ratio of ferrite may also be 82% or more, 85% or more, 87% or more, or 90% or more. The upper limit of the area ratio of the ferrite is not particularly prescribed, but may be 100%. For example, the area ratio of ferrite may also be 98% or less, 96% or less, or 94% or less.

[At Least One of Tempered Martensite, Bainite, and Retained Austenite: Less than 20% in Total]

The microstructure of the surface layer soft part may contain any other structures so long as satisfying the requirement of containing, by area ratio, 80% or more ferrite. While not particularly limited, for example, at the surface layer soft part, the total of the area ratios of the at least one of tempered martensite, bainite, and retained austenite is preferably less than 20%.

Tempered martensite and bainite form hard structures. Further, retained austenite transforms to hard as-quenched martensite by work induced transformation. For this reason, from the viewpoint of further improving the bendability in steel sheet, for example, the total of the area ratios of the at least one of tempered martensite, bainite, and retained austenite may be 18% or less, 16% or less, 14% or less, or 12% or less. The total of the area ratios of the at least one of tempered martensite, bainite, and retained austenite may also be 0%, but, for example, may also be 1% or more, 3% or more, 5% or more, 8% or more, or 10% or more.

[Pearlite: Less than 5%]

As explained above, by the microstructure of the surface layer soft part containing, by area ratio, 80% or more ferrite, a sufficiently high bendability can be achieved, but from the viewpoint of further improving the bendability of the steel sheet, the area ratio of the hard structure pearlite is preferably less than 5%. The area ratio of pearlite may also be 4.5% or less, 4% or less, or 3% or less. On the other hand, the lower limit of the area ratio of pearlite is not particularly prescribed and may also be 0%. For example, the area ratio of pearlite may also be 1% or more or 2% or more.

[As-Quenched Martensite: Less than 5%]

In the same way as the case of pearlite, from the viewpoint of further improving the bendability of the steel sheet, the area ratio of the hard structure as-quenched martensite is preferably less than 5%. The area ratio of the as-quenched martensite may also be 4% or less or 3% or less. On the other hand, the lower limit of the area ratio of the as-quenched martensite is not particularly prescribed and may also be 0%. For example, the area ratio of the as-quenched martensite may be 1% or more or 2% or more.

[Identification of Microstructure and Calculation of Area Ratios at Surface Layer Soft Part]

At the surface layer soft part, the microstructure is identified and the area ratios are calculated in the following way. First, a sample having a sheet thickness cross-section parallel to the rolling direction of the steel sheet is taken. That cross-section is made the examined surface. In this examined surface, several examined regions are randomly selected so that there is no bias in the sheet thickness direction within the range defined as the surface layer soft part. The total area of these examined regions is $2.0\times10^{-9}$ $m^2$ or more. The identification of the microstructure and calculation of the area ratios other than the retained austenite are the same as the identification of the microstructure and calculation of the area ratios at the sheet thickness center part other than the difference of the examined regions.

[Retained Austenite]

The volume ratio of the retained austenite of the surface layer soft part is found by acquiring information on the crystal orientations of the examined regions using electron backscatter diffraction (EBSD). Specifically, first, a sample having a sheet thickness cross-section parallel to the rolling direction of the steel sheet is taken. That cross-section is made the examined surface. Wet polishing by emery paper, polishing by a diamond abrasive having a 1 μm average particle size, and chemical polishing are successively applied to the examined surface. Next, at the polished examined surface, several examined regions are randomly selected in the range defined as the surface layer soft part so that there is no concentration in the sheet thickness direction and the crystal orientations in a total of $2.0\times10^{-9}$ $m^2$ or more regions are acquired at 0.05 μm intervals. As the software for obtaining the data on the crystal orientations, the software "OIM Data Collection™ (ver. 7)" made by TSL Solutions is used. The acquired crystal orientation information is separated into the bcc phase and the fcc phase by the software "OIM Analysis™ (ver. 7)" made by TSL Solutions. This fcc phase is retained austenite. The volume ratio of the retained austenite obtained in such a way is determined as the area ratio of the retained austenite.

[Chemical Composition of Surface Layer Soft Part]

In an embodiment of the present invention, the chemical composition of the surface layer soft part is basically equal to the chemical composition of the sheet thickness center part except that the concentration of carbon near the surface becomes lower. From the definition of the surface layer soft part explained previously, the C content of the surface layer soft part becomes 0.5 time or less the C content of the sheet thickness center part.

[Thickness of Internal Oxide Layer: 3 μm or More]

In an embodiment of the present invention, the surface layer soft part includes an internal oxide layer having a thickness of 3 μm or more from the surface of the steel sheet (if there is a plated layer present on the surface of the steel sheet, the interface of the plated layer and steel sheet). Due to this, motion of the dislocations contained in the steel is pinned by the numerous fine oxide particles present in the internal oxide layer and, as a result, it is believed that it is possible to remarkably raise the surface hardness of the steel sheet. The thickness of the internal oxide layer may also be 4 μm or more, 5 μm or more, 6 μm or more, 8 μm or more, or 10 μm or more. The upper limit of the thickness of the internal oxide layer is not particularly limited, but, for example, the thickness of the internal oxide layer may also be 30 μm or less, 25 μm or less, or 20 μm or less.

The "thickness of the internal oxide layer" means the distance from the steel sheet surface to the furthest position where the internal oxides are present in the case of proceeding from the surface of the steel sheet in the thickness direction of the steel sheet (the direction vertical to the surface of the steel sheet). The thickness of the internal oxide layer is determined by taking a sample having a sheet thickness cross-section parallel to the rolling direction of the steel sheet and including the surface layer part of the steel sheet and examining the cross-section by an SEM. The measured depth is a region down to 50 μm from the surface of the steel sheet.

[Void Area Ratio Near Surface Layer: 3.0% or Less]

In an embodiment of the present invention, the void area ratio at the region from the surface of the steel sheet (if there is a plated layer present at the surface of the steel sheet, the interface of the plated layer and the steel sheet) down to a 10 μm depth position is 3.0% or less. If there is a certain amount or more of voids (cavities) present near the surface layer, when the steel sheet receives some sort of external force, for example, external force of a bending operation etc., sometimes the voids become starting points for formation of defects due to peeling, etc. According to an embodiment of the present invention, by controlling the void area ratio at the region from the surface of the steel sheet down to a 10 μm depth position to 3.0% or less, it becomes possible to reliably suppress formation of such defects. The void area ratio may also be 2.0% or less, 1.5% or less, or 1.0% or less. The lower limit of the void area ratio is not particularly prescribed and may also be 0%. For example, the void area ratio may also be 0.1% or more or 0.5% or more.

In the present invention, the void area ratio is determined in the following way. First, the examined surface is polished to a mirror finish by buffing. This is used as the examined sample. Next, an SEM is used to capture an image centered on a position 5 μm down from the surface of the examined sample or interface between the plated layer and base iron by a magnification of 9000×. Using a 10 μm×10 μm region as one field, reflected electron topographic images of 15 adjoining consecutive fields are obtained. Regions where topographic parts were observed are analyzed by an energy dispersion type X-ray spectrograph (EDS), whether they are inclusions or voids is discriminated, only simple cavity parts are counted as voids, and the ratio of voids in the 10 μm×150 μm region captured by the SEM is determined as the void area ratio.

[Sheet Thickness]

The high strength steel sheet according to an embodiment of the present invention generally has a 0.6 to 6.0 mm sheet thickness. While not particularly limited, the sheet thickness may be 1.0 mm or more, 1.2 mm or more, or 1.4 mm or more and/or may be 5.0 mm or less, 4.0 mm or less, 3.0 mm or less, or 2.5 mm or less.

[Plating]

The high strength steel sheet according to an embodiment of the present invention may further contain a plated layer at the surface of the surface layer soft part for the purpose of improving the corrosion resistance, etc. The plated layer may be either a hot dip coated layer and electroplated layer. A "hot dip coated layer", for example, includes a hot dip galvanized layer, hot dip galvannealed layer, hot dip aluminum coated layer, hot dip Zn—Al alloy coated layer, hot dip Zn—Al—Mg alloy coated layer, hot dip Zn—Al—Mg—Si alloy coated layer, etc. An "electroplated layer", for example, includes an electrogalvanized layer, electro Zn—Ni alloy plated layer, etc. Preferably, the plated layer is a hot dip galvanized layer, hot dip galvannealed layer, or electrogalvanized layer. The amount of deposition of the plated layer is not particularly limited and may be a general amount of deposition.

[Mechanical Properties]

According to the high strength steel sheet according to an embodiment of the present invention, excellent mechanical properties, for example, a 1250 MPa or more tensile strength, can be achieved. The tensile strength is preferably 1300 MPa or more, more preferably 1350 MPa or more. The upper limit is not particularly prescribed, but, for example, the tensile strength may also be 2000 MPa or less, 1800 MPa or less, or 1650 MPa or less. Similarly, according to the high strength steel sheet according to an embodiment of the present invention, a high strength can be achieved. More specifically, a more than 400 Hv average Vickers hardness (Hc) of the sheet thickness center part (i.e., average Vickers hardness at the sheet thickness ½ position) can be achieved. The average Vickers hardness (Hc) of the sheet thickness center part is preferably 415 Hv or more, more preferably 430 Hv or more. Furthermore, according to the high strength steel sheet according to an embodiment of the present invention, it is possible to achieve excellent bendability, more specifically possible to achieve a 10% or more total elongation. The total elongation is preferably 11% or more, more preferably 12% or more. The upper limit is not particularly prescribed, but, for example, the total elongation may also be 25% or less or 20% or less. The tensile strength and total elongation are measured by conducting a tensile test compliant with JIS Z2241: 2011 based on a JIS No. 5 test piece taken from a direction (C direction) parallel to the width direction of the steel sheet.

The high strength steel sheet according to an embodiment of the present invention has an improved bendability and has a high resistance to formation of defects and maintains its appearance properties well, therefore, for example, is extremely useful for use as a framework member of an automobile in which outer appearance is particularly demanded. Further, the high strength steel sheet is high in surface hardness and therefore is also excellent in wear resistance, therefore, for example, is extremely suitable in applications such as booms of cranes for construction machinery in which not only high strength but also high bendability and wear resistance are sought.

<Method for Producing High Strength Steel Sheet>

Next, a preferable method for producing the high strength steel sheet according to an embodiment of the present invention will be explained. The following explanation is intended to illustrate a characteristic method for producing the high strength steel sheet according to an embodiment of the present invention and is not intended to limit the high strength steel sheet to one produced by the method of production explained below.

The method for producing the high strength steel sheet according to an embodiment of the present invention is characterized by comprising:

- a hot rolling step including heating a slab having the chemical composition explained above in relation to the sheet thickness center part to a temperature of 1100 to 1250° C., then finish rolling it and immediately cooling the finish rolled steel sheet by an average cooling rate of 40° C./s or more, and coiling it at a temperature of 590° C. or less, wherein an end temperature of the finish rolling is 840 to 1050° C., a maximum temperature of the hot rolled coil after coiling is controlled to 580° C. or less, and a holding time in a temperature region from the maximum temperature down to 500° C. is restricted to 4 hours or less,
- a step of pickling the obtained hot rolled steel sheet,
- a cold rolling step of cold rolling the pickled hot rolled steel sheet by a rolling reduction of 30 to 80%,
- an annealing step including heating the objected cold rolled steel sheet in an atmosphere of a logarithm log $P_{O2}$ of the oxygen partial pressure $P_{O2}$ (atm) of −20 to −16 at a temperature region of (Ac3−30)° C. or more,
- a cooling step including primary cooling the cold rolled steel sheet by an average cooling rate of 0.5 to 20° C./s down to a temperature of 680 to 780° C., then secondary cooling it by an average cooling rate of more than 20° C./s down to a temperature of 25 to 600° C., and a tempering step including making the cold rolled steel sheet dwell in a temperature region of 100 to 400° C. for 150 to 1000 seconds. Below, the individual steps will be explained in detail.

[Hot Rolling Step]

[Heating of Slab]

First, a slab having the chemical composition explained above in relation to the sheet thickness center part is heated. The slab used is preferably cast by continuous casting from the viewpoint of productivity, but it may also be produced by the ingot making or thin slab casting method. The slab used contains a relatively large amount of alloy elements so as to obtain a high strength steel sheet. For this reason, it is necessary to heat the slab so make the alloy elements dissolve in the slab before sending it on for hot rolling. If the heating temperature is less than 1100° C., the alloy elements will not sufficiently dissolve in the slab and coarse alloy carbides will remain sometimes causing embrittlement cracks during hot rolling. For this reason, the heating temperature is preferably 1100° C. or more. The upper limit of the heating temperature is not particularly prescribed, but from the viewpoint of the capacity of the heating facilities and productivity, is preferably 1250° C. or less.

[Rough Rolling]

In the present method, for example, the heated slab may be rough rolled before the finish rolling so as to adjust the sheet thickness, etc. The rough rolling need only be one by which the desired sheet bar dimensions can be secured. The conditions are not particularly limited.

[Finish Rolling]

The heated slab or slab additionally rough rolled according to need is then finish rolled. In the above way, the slab used contains relatively large amounts of alloy elements, therefore at the time of hot rolling, the rolling load has to be made larger. For this reason, the hot rolling is preferably performed at a high temperature. In particular, the end temperature of the finish rolling is important in the point of the control of the metallographic structure of the steel sheet. If the end temperature of the finish rolling is low, the metallographic structure becomes uneven and sometimes the formability falls. For this reason, the end temperature of the finish rolling is preferably 840° C. or more. On the other hand, to keep the austenite from coarsening, the end temperature of the finish rolling is preferably 1050° C. or less.

[Coiling]

Next, the finish rolled steel sheet is immediately cooled by an average cooling rate of 40° C./s or more, for example, 40 to 100° C./s, then is coiled at a temperature of 590° C. or less. If the time from after the finish rolling until the start of cooling is long or the average cooling rate after the finish rolling is slow or the coiling temperature is high, formation of an internal oxide layer is promoted at the surface layer of the hot rolled steel sheet. Since the formed internal oxide layer cannot be sufficiently removed even by the subsequent pickling, the cold rolling step is performed in a state including the internal oxide layer. In this case, at the time of cold rolling, voids are formed around the internal oxides. At the finally obtained steel sheet, sometimes a void area ratio of 3.0% or less cannot be achieved. To reliably keep such an internal oxide layer from being formed in the hot rolling step, the finish rolled steel sheet has to be immediately cooled by an average cooling rate of 40° C./s or more, more specifically is cooled by an average cooling rate of 40° C./s or more within 3 seconds after the finish rolling. For the same reasons, the coiling temperature has to be 590° C. or less, preferably is less than 550° C.

The maximum temperature of the hot rolled coil after coiling (hot rolled steel sheet) is controlled to 580° C. or less and the holding time in a temperature region from the maximum temperature of the hot rolled coil down to 500° C. is restricted to 4 hours or less. To keep voids from being formed around the internal oxides at the time of cold rolling, in addition to controlling the cooling and the coiling temperature after the finish rolling, suitably controlling the heat history of the hot rolled coil after coiling is important. For example, sometimes the hot rolled coil after coiling is treated for soaking so as to secure cold rollability, but if such soaking treatment is high in temperature and long in treatment time, sometimes the oxide scale of the hot rolled coil and the internal oxide layer of the surface layer are formed thick. In such a case, even with subsequent pickling, it is not possible to sufficiently remove these. Uneven removal occurs along the width direction and length direction of the hot rolled coil and, due to this, sometimes voids are formed. The transformation of the steel microstructure is an exothermic reaction, therefore depending on the transformation speed, even after coiling, sometimes the temperature will rise above the coiling temperature. Therefore, suitably monitoring and controlling the heat history of the hot rolled coil after coiling to suppress excessive formation of oxide scale or an internal oxide layer become extremely important. Preferably, the maximum temperature of the hot rolled coil after coiling is controlled to 570° C. or less and the holding time in the temperature region from the maximum temperature of the hot rolled coil down to 500° C. is restricted to 3.5 hours or less. The method of measurement and measurement location of the temperature are not particularly limited, but for example the temperature at a position about 25 μm from the inside end part of the hot rolled coil toward the outside end in the length direction of the hot rolled coil may be measured by ThermoViewer from the outside or may be measured by inserting a thermocouple into the hot rolled coil.

[Pickling Step]

Next, the obtained hot rolled steel sheet is pickled to remove the oxide scale formed at the surface of the hot rolled steel sheet. The pickling may be performed under conditions suitable for removing the oxide scale. It may be performed one time or performed divided into several times for reliably removing the oxide scale.

[Cold Rolling Step]

The pickled hot rolled steel sheet is cold rolled at the cold rolling step by a rolling reduction of 30 to 80%. By making the rolling reduction of the cold rolling 30% or more, it is possible to keep the shape of the cold rolled steel sheet flat and keep the ductility at the final product from dropping. The rolling reduction of the cold rolling is preferably 50% or more. On the other hand, by making the rolling reduction of the cold rolling 80% or less, it is possible to prevent the rolling load from becoming excessive and rolling becoming difficult. The rolling reduction of the cold rolling is preferably 70% or less. The number of rolling passes and the rolling reduction at each pass are not particularly limited and may be suitably set so that the rolling reduction of the cold rolling as a whole becomes the above range.

[Annealing Step]

[Logarithm log $P_{O2}$ of Oxygen Partial Pressure $P_{O2}$ (atm) of Atmosphere: −20 to −16]

[Annealing Temperature Region: (Ac3−30)° C. or More]

The obtained cold rolled steel sheet is annealed by being heated in, for example, a heating furnace and soaking furnace of a continuous annealing line in a temperature region of (Ac3−30°) C or more while maintaining the logarithm log $P_{O2}$ of the oxygen partial pressure $P_{O2}$ (atm) of the internal furnace atmosphere at −20 to −16. Here, the Ac3 point can be calculated approximately based on the following formula:

$$Ac3 = 937.2 - 436.5 \times [C] + 56 \times [Si] - 19.7 \times [Mn] - 16.3 \times [Cu] - 26.6 \times [Ni] - 4.9 \times [Cr] + 38.1 \times [Mo] + 124.8 \times [V] + 136.3 \times [Ti] - 19.1 \times [Nb] + 198.4 \times [Al] + 3315 \times [B]$$

where [C], [Si], [Mn], [Cu], [Ni], [Cr], [Mo], [V], [Ti], [Nb], [Al], and [B] are contents (mass %) of elements in the steel sheet.

By performing the annealing in the above such relatively oxidizing atmosphere and under high temperature conditions, it is possible to soften the surface layer part of the steel sheet by decarburization to form the desired surface layer soft part and to make the oxygen from the atmosphere diffuse into the steel to form the desired internal oxide layer near the surface of the steel sheet. More specifically, by heating in the heating furnace and soaking furnace at the temperature region of (Ac3−30°) C or more, decarburization proceeds at the surface layer part of the steel sheet and the amount of carbon at the surface layer part falls. By the amount of carbon of the surface layer part falling, the quenchability of the surface layer part falls, so it becomes possible to obtain a suitable amount of ferrite at the surface layer part. To make such decarburization proceed, it is necessary to control the oxygen partial pressure $P_{O2}$ (atm) of the internal furnace atmosphere to a suitable range. If the logarithm log $P_{O2}$ of the oxygen partial pressure $P_{O2}$ of the atmosphere is −20 or more, the oxygen potential becomes sufficiently high and decarburization proceeds. In addition, in such an oxidizing atmosphere, diffusion of oxygen from the atmosphere to inside the steel is promoted, internal oxidation of the Si, Al, Mn, Cr, etc., present near the surface of the steel sheet proceeds, and it is possible to form an internal oxide layer having a sufficient thickness, more specifically a 3 μm or more thickness, near the surface of the steel sheet. The log $P_{O2}$ is preferably −19 or more. On the other hand, by controlling log $P_{O2}$ to −16 or less, it is possible to suppress excessive decarburization and internal oxidation due to the oxygen potential being too high. For this reason, it is possible to reliably obtain the desired surface layer soft part and internal oxide layer. Further, oxidation of not only Si, Al, Mn, etc., but also the base steel sheet itself, is suppressed and it is possible to make the desired surface conditions at the steel sheet easier to obtain. The log $P_{O2}$ is preferably −17 or less. According to this method, the internal oxide layer is formed in the annealing step after the cold rolling step, therefore compared with the case where the internal oxide layer is formed in the hot rolling step, voids are not formed around the internal oxides at the time of cold rolling and, in the finally obtained steel sheet, a 3.0% or less void area ratio can be reliably achieved.

In addition, in the annealing step, by heating at a temperature region of (Ac3−30°) C or more, austenite is formed during the annealing and it is possible to obtain a predetermined amount of tempered martensite as the final structures at the sheet thickness center part. For this reason, it becomes possible to achieve the desired high strength at the steel sheet. On the other hand, if the temperature region of the annealing is too high, while there is no problem in the properties of the steel sheet, the productivity falls. For this reason, the heating temperature region of the annealing step is preferably 1100° C. or less, more preferably 950° C. or less. For example, if forming the surface layer soft part at only one side of the steel sheet, at the time of the main annealing step, it is also possible to superpose two cold rolled steel sheets and perform annealing under the conditions explained above so as to decarburize and soften only single surface layer parts of the steel sheets.

[Cooling Step]

After the annealing step, to form the desired microstructure at the surface layer soft part and the sheet thickness center part, the obtained cold rolled steel sheet is subjected to primary cooling by an average cooling rate of 0.5 to 20° C./s down to a temperature of 680 to 780° C., then subjected to secondary cooling by an average cooling rate of more than 20° C./s down to a temperature of 25 to 600° C.

[Primary Cooling: Cooling by Average Cooling Rate of 0.5 to 20° C./s Down to Temperature of 680 to 780° C.]

By making the average cooling rate of the primary cooling 20° C./s or less, it is possible to promote the formation of ferrite at the surface layer soft part. Further, the upper limit of the average cooling rate in the primary cooling is prescribed so as to reliably obtain the effect of dividing the cooling step in the two stages of the primary cooling and secondary cooling. From such a viewpoint, the average cooling rate of the primary cooling is preferably 18° C./s or less, more preferably 16° C./s or less. By making the cooling step such two stages, for example, it is possible to not allow the formation of pearlite, etc., at the surface layer soft part or suppress the formation of pearlite, etc., while achieving a higher area ratio of ferrite. On the other hand, by making the average cooling rate of the primary cooling 0.5° C./s or more, excessive progression of ferrite transformation and pearlite transformation at not only the surface layer soft part, but also the sheet thickness center part is suppressed, so it is possible to easily obtain the predetermined amount of tempered martensite at the sheet thickness center part. The average cooling rate of the primary cooling is preferably 1° C./s or more, more preferably 2° C./s or more. Further, by making the cooling stop temperature of the primary cooling 680° C. or more, it is possible to keep large amounts of structures other than ferrite from being formed at surface layer soft part and the bendability of the steel sheet from falling. The cooling stop temperature of the primary cooling is preferably 700° C. or more. On the other hand, by making the cooling stop temperature of the primary cooling 780° C. or less, it is possible to promote the formation of ferrite at the surface layer soft part.

[Secondary Cooling: Cooling by Average Cooling Rate of More than 20° C./s Down to Temperature of 25 to 600° C.]

The average cooling rate and the cooling stop temperature of the secondary cooling are particularly important in forming the as-quenched martensite for obtaining a predetermined amount of tempered martensite at the sheet thickness center part. As-quenched martensite is formed by transformation using as nuclei the fine amount of dislocations present at austenite grains before transformation at the temperature region of 25 to 600° C. By making the average cooling rate from after the primary cooling until reaching the temperature region of 25 to 600° C. more than 20° C./s, it is possible to keep the dislocations contained at the austenite grains before transformation from being used up. As a result, it is possible to reliably achieve 85% or more tempered martensite at the final microstructure of the sheet thickness center part. The average cooling rate of the secondary cooling is preferably 23° C./s or more. Further, the cooling stop temperature of the secondary cooling is 25° C. or more, but from the viewpoint of further raising the productivity, it is preferably 100° C. or more. On the other hand, by making the cooling stop temperature 600° C. or less, it is possible to suppress the formation of ferrite, bainite, and pearlite at the sheet thickness center part while reliably forming a predetermined amount of martensite. The cooling stop temperature of the secondary cooling is preferably 500° C. or less.

[Tempering Step]

After the cooling step, the cold rolled steel sheet includes mainly as-quenched martensite at the sheet thickness center part. Therefore, at the next tempering step, this as-quenched martensite has to be tempered to tempered martensite. More specifically, at the tempering step, the cold rolled steel sheet is made to dwell at the temperature region of 100 to 400° C. for 150 to 1000 seconds to thereby temper the as-quenched martensite at the sheet thickness center part to tempered martensite. Compared to when the sheet thickness center part mainly contains as-quenched martensite, it is possible to raise the workability of the steel sheet. By making the dwell temperature 100° C. or more, it is possible to reliably obtain the effect of tempering. On the other hand, by making the dwell temperature 400° C. or less, it becomes possible to suppress excessive tempering and maintain the strength of the steel sheet high in level. Further, by making the dwell time 150 seconds or more, it is possible to reliably obtain the desired amount of tempered martensite. On the other hand, from the viewpoint of productivity, the dwell time is preferably 1000 seconds or less.

[Plating Treatment and Surface Treatment]

If hot dip galvanizing the steel sheet as plating treatment, for example, the steel sheet is heated or cooled to a temperature lower by 40° C. from the temperature of the galvanizing bath or more and a temperature higher by 50° C. from the temperature of the galvanizing bath or less, then the steel sheet is run through the galvanizing bath. By such hot dip galvanization, steel sheet provided with a hot dip galvanized layer at the surface, i.e., hot dip galvanized steel sheet, is obtained. The hot dip galvanized layer has a chemical composition comprised of, for example, Fe: 7 to 15 mass % and a remainder: Zn, Al, and impurities. Further, the hot dip galvanized layer may also be a zinc alloy.

If treating the steel sheet for alloying after the hot dip galvanization, for example, the hot dip galvanized steel sheet is heated to a 460° C. or more and 600° C. or less temperature. If the heating temperature is less than 460° C., sometimes the alloying is insufficient. On the other hand, if the heating temperature is more than 600° C., the alloying becomes excessive and sometimes the corrosion resistance deteriorates. Due to such alloying treatment, steel sheet provided with a hot dip galvannealed layer on its surface, i.e., hot dip galvannealed steel sheet, is obtained.

Further, the steel sheet may be electroplated, vacuum deposition plated, or otherwise plated. Further, after electroplating, it may be treated for alloying. Further, an organic coating may be formed, a film may be laminated, organic salts or inorganic salts may be used for treatment, non-chrome treatment may be performed, or other surface treatment may be applied to the steel sheet.

[Post Process Tempering]

Finally, to adjust the strength, etc., of the steel sheet, optionally the steel sheet may be subjected to additional tempering. Such tempering is not particularly limited. For example, it may be performed by making the steel sheet dwell in the temperature region of 200 to 500° C. for 2 seconds or more.

Below, examples will be used to explain the present invention in more detail, but the present invention is not limited to these examples in any way.

EXAMPLES

Examples A

In each of these examples, first, a sheet thickness 20 mm continuously cast slab having a chemical composition shown in Table 1 was heated to a predetermined temperature of within a range of 1100 to 1250° C. and was hot rolled under conditions giving an end temperature of the finish rolling of 840 to 1050° C. Within 3 seconds after the finish rolling, the steel sheet was cooled by a 40° C./s average cooling rate, then was coiled at a coiling temperature shown in Table 2. In the hot rolled coil after coiling, the maximum temperature was controlled to 580° C. or less. The holding time at the temperature range of the maximum temperature of the hot rolled coil down to 500° C. was 3.5 hours or less. The temperature of the hot rolled coil was measured by inserting a thermocouple at a position of about 25 m from the inside end part of the hot rolled coil toward the outside end part in the length direction. Next, the obtained hot rolled steel sheet was pickled, then cold rolled by the rolling reduction shown in Table 2. Next, the obtained cold rolled steel sheet was annealed under the conditions shown in Table 2 to thereby decarburize and soften the surface layer part of the steel sheet, then was similarly cooled and tempered under the conditions shown in Table 2. In Table 3, steel sheet provided with the surface layer soft part at only one side was decarburized and softened at only one surface layer part of the steel sheet by stacking two cold rolled steel sheets for annealing at the time of the annealing step. Finally, in accordance with need, plating and alloying and additional tempering treatment were performed to obtain the product steel sheet. A sample taken from the obtained steel sheet was analyzed for the chemical composition of the part corresponding to the sheet thickness center part, whereupon there was no change from the chemical composition shown in Table 1.

TABLE 1

| Constit- | Sheet thickness center part (mass %, remainder: Fe and impurities) | | | | | | | | | | | |
|---|---|---|---|---|---|---|---|---|---|---|---|---|
| uent | C | Si | Mn | P | S | Al | N | O | Cr | Mo | B | Ti |
| A | 0.20 | 0.50 | 2.06 | 0.013 | 0.0051 | 0.03 | 0.0024 | 0.0021 | | | | |
| B | 0.22 | 0.70 | 5.30 | 0.010 | 0.0400 | 0.05 | 0.0031 | 0.0029 | | | | |
| C | 0.16 | 0.35 | 1.56 | 0.013 | 0.0057 | 0.04 | 0.0041 | 0.0027 | | 0.05 | 0.0014 | 0.03 |
| D | 0.15 | 0.56 | 9.20 | 0.012 | 0.0029 | 0.06 | 0.0031 | 0.0031 | | | | |
| E | 0.24 | 0.80 | 2.60 | 0.011 | 0.0050 | 0.02 | 0.0015 | 0.0014 | | | | |
| F | 0.22 | 0.17 | 2.80 | 0.012 | 0.0039 | 0.04 | 0.0037 | 0.0017 | | | | |
| G | 0.13 | 0.77 | 1.50 | 0.010 | 0.0050 | 0.06 | 0.0043 | 0.0015 | | | 0.0015 | |
| H | 0.15 | 0.60 | 2.50 | 0.011 | 0.0058 | 0.05 | 0.0029 | 0.0023 | | | | |

TABLE 1-continued

| | | | | | | | | | | | | |
|---|---|---|---|---|---|---|---|---|---|---|---|---|
| I | 0.30 | 1.30 | 0.52 | 0.015 | 0.0018 | 0.03 | 0.0043 | 0.0018 | 0.30 | | 0.0020 | 0.02 |
| J | 0.26 | 0.50 | 1.55 | 0.006 | 0.0058 | 0.05 | 0.0021 | 0.0028 | | | 0.0016 | |
| K | 0.18 | 2.10 | 2.60 | 0.008 | 0.0033 | 0.05 | 0.0041 | 0.0023 | 0.50 | | 0.0020 | 0.02 |
| L | 0.20 | 0.36 | 2.76 | 0.015 | 0.0200 | 0.03 | 0.0044 | 0.0018 | | | | |
| M | 0.29 | 0.05 | 2.43 | 0.008 | 0.0055 | 0.05 | 0.0016 | 0.0031 | | | | |
| N | 0.24 | 0.64 | 2.35 | 0.007 | 0.0027 | 0.04 | 0.0024 | 0.0022 | | | | |
| O | 0.11 | 0.27 | 2.60 | 0.006 | 0.0012 | 0.03 | 0.0038 | 0.0012 | | | | |
| P | 0.27 | 0.21 | 1.17 | 0.010 | 0.0059 | 0.05 | 0.0024 | 0.0031 | 1.80 | 0.20 | 0.0020 | |
| Q | 0.26 | 0.61 | 1.80 | 0.010 | 0.0018 | 0.04 | 0.0034 | 0.0032 | | | | 0.03 |
| R | 0.29 | 0.10 | 0.90 | 0.013 | 0.0026 | 1.30 | 0.0026 | 0.0029 | 0.30 | 0.20 | 0.0030 | |
| S | 0.13 | 0.73 | 0.27 | 0.010 | 0.0018 | 0.04 | 0.0040 | 0.0024 | 0.50 | 0.80 | 0.0020 | 0.02 |
| T | 0.19 | 0.44 | 1.67 | 0.010 | 0.0052 | 0.03 | 0.0028 | 0.0029 | | | | |
| U | 0.12 | 0.53 | 2.18 | 0.006 | 0.0021 | 0.02 | 0.0037 | 0.0018 | 0.20 | 0.10 | 0.0020 | 0.02 |
| V | **0.06** | 1.60 | 2.50 | 0.020 | 0.0056 | 0.13 | 0.0021 | 0.0011 | | | | |
| W | **0.45** | 1.20 | 2.00 | 0.020 | 0.0042 | 0.13 | 0.0035 | 0.0035 | | | | |
| X | 0.25 | **2.70** | 2.60 | 0.020 | 0.0048 | 0.06 | 0.0037 | 0.0016 | | | | |
| Y | 0.25 | 1.20 | **10.90** | 0.020 | 0.0038 | 0.12 | 0.0018 | 0.0028 | | | | |
| Z | 0.25 | 1.20 | 3.20 | 0.020 | 0.0010 | **1.80** | 0.0036 | 0.0013 | 1.60 | | | |
| AA | 0.25 | 1.20 | 1.60 | 0.018 | 0.0010 | 0.02 | 0.0029 | 0.0034 | **2.60** | | | |
| AB | 0.28 | 0.20 | 1.00 | 0.010 | 0.0090 | 0.02 | 0.0024 | 0.0015 | | | 0.0020 | 0.02 |

| | Sheet thickness center part (mass %, remainder: Fe and impurities) | | | | | | | | |
|---|---|---|---|---|---|---|---|---|---|
| Constituent | Nb | V | Cu | Ni | Ca | Mg | REM | Si + Mn + Al + Cr | Ac3 |
| A | | | | | | | | 2.59 | 843 |
| B | | | | | | | | 6.05 | 786 |
| C | | | | | | | | 1.95 | 875 |
| D | | | 0.05 | | | | | 9.82 | 733 |
| E | | | | | | | | 3.42 | 830 |
| F | | | | | | | | 3.01 | 803 |
| G | | | | | | | | 2.33 | 911 |
| H | | | | | | | | 3.15 | 866 |
| I | | | | | | | | 2.15 | 883 |
| J | | | | | | | | 2.10 | 836 |
| K | | | | | | | | 5.25 | 942 |
| L | | | | | | | 0.010 | 3.15 | 822 |
| M | | | | | 0.0014 | | | 2.53 | 775 |
| N | | | | | | 0.0012 | | 3.03 | 830 |
| O | | | | | | | | 2.90 | 859 |
| P | | | | 0.30 | | | | 3.23 | 815 |
| Q | | | 0.10 | | | | | 2.45 | 833 |
| R | 0.03 | | 0.20 | 0.10 | | | | 2.60 | 1066 |
| S | | 0.02 | | | | | | 1.54 | 964 |
| T | | 0.06 | | | | | | 2.14 | 859 |
| U | 0.02 | | | | | | 0.020 | 2.93 | 887 |
| V | | | | | | | | 4.23 | 977 |
| W | | | | | | | | 3.33 | 794 |
| X | | | | | | | | 5.36 | 940 |
| Y | | | | | | | | 12.22 | 704 |
| Z | 0.28 | | 0.90 | 0.80 | | | | 7.80 | 1140 |
| AA | | | | | | | | 5.42 | 855 |
| AB | | | 0.50 | 0.20 | | | | **1.22** | 806 |

Bold underlines indicate outside preferable range.

TABLE 2

| | | Hot rolling step | | | Cold rolling step | | Annealing step | | |
|---|---|---|---|---|---|---|---|---|---|
| No. | Constituent | Slab heating temp. (° C.) | Finish rolling end temp. (° C.) | Coiling temp. (° C.) | Rolling reduction (%) | Internal oxide layer thickness after cold rolling (μm) | logPO2 | Ac3-30 (° C.) | Heating temp. (° C.) |
| 1 | A | 1233 | 859 | 491 | 35 | 0 | −18 | 813 | 860 |
| 2 | B | 1235 | 867 | 581 | 66 | 0 | −18 | 756 | 893 |
| 3 | C | 1205 | 859 | 563 | 76 | 0 | −17 | 845 | 889 |
| 4 | D | 1238 | 920 | 435 | 45 | 0 | −17 | 703 | 896 |
| 5 | E | 1228 | 859 | 530 | 40 | 0 | −20 | 800 | 866 |
| 6 | F | 1236 | 856 | 472 | 73 | 0 | −19 | 773 | 895 |
| 7 | G | 1123 | 860 | 550 | 77 | 0 | −17 | 881 | 932 |

TABLE 2-continued

| | | | | | | | | | |
|---|---|---|---|---|---|---|---|---|---|
| 8 | H | 1112 | 855 | 508 | 73 | 0 | −19 | 836 | 880 |
| 9 | I | 1143 | 937 | 582 | 37 | 0 | −20 | 853 | 890 |
| 10 | J | 1223 | 882 | 515 | 76 | 0 | −18 | 806 | 884 |
| 11 | K | 1239 | 859 | 588 | 36 | 0 | −18 | 912 | 948 |
| 12 | L | 1121 | 872 | 582 | 35 | 0 | −19 | 792 | 891 |
| 13 | M | 1173 | 930 | 481 | 70 | 0 | −19 | 745 | 854 |
| 14 | N | 1238 | 862 | 407 | 76 | 0 | −19 | 800 | 893 |
| 15 | O | 1221 | 860 | 578 | 36 | 0 | −17 | 829 | 889 |
| 16 | P | 1236 | 860 | 567 | 76 | 0 | −16 | 785 | 854 |
| 17 | Q | 1243 | 901 | 543 | 36 | 0 | −19 | 803 | 854 |
| 18 | R | 1238 | 859 | 576 | 76 | 0 | −17 | 1036 | 1080 |
| 19 | S | 1235 | 920 | 452 | 34 | 0 | −17 | 934 | 935 |
| 20 | T | 1135 | 862 | 577 | 37 | 0 | −16 | 829 | 875 |
| 21 | U | 1119 | 857 | 435 | 54 | 0 | −18 | 857 | 910 |
| 22 | V | 1237 | 900 | 411 | 39 | 0 | −19 | 947 | 948 |
| 23 | W | 1236 | 953 | 556 | 74 | 0 | −18 | 764 | 854 |
| 24 | X | 1239 | 859 | 391 | 52 | 0 | −16 | 910 | 920 |
| 25 | Y | 1216 | 856 | 550 | 65 | 0 | −19 | 674 | 891 |
| 26 | Z | 1220 | 1020 | 580 | 50 | 0 | −18 | 1110 | **950** |
| 27 | AA | 1204 | 880 | 570 | 60 | 0 | −19 | 825 | 900 |
| 28 | AB | 1212 | 885 | 554 | 79 | 0 | −20 | 776 | 890 |
| 29 | H | 1216 | 856 | **710** | 65 | 12 | −19 | 836 | 891 |
| 30 | H | 1220 | 860 | 590 | 67 | 0 | −18 | 836 | 860 |
| 31 | H | 1230 | 850 | 580 | 75 | 0 | −17 | 836 | 880 |
| 32 | H | 1220 | 845 | 577 | 74 | 0 | **−21** | 836 | 840 |

| | Cooling step | | | | | | | | | | |
|---|---|---|---|---|---|---|---|---|---|---|---|
| | Primary cooling | | Secondary cooling | | Tempering step | | | | | | |
| No. | Average cooling speed (° C./s) | Cooling step temp. (° C.) | Average cooling speed (° C./s) | Cooling step temp. (° C.) | Dwell temp. (° C.) | Dwell time (s) | Plating | Alloying | Tempering of later step | Tempering temp. (° C.) | Tempering time (s) |
| 1 | 4 | 747 | 49 | 167 | 106 | 922 | No | No | Yes | 350 | 500 |
| 2 | 2 | 753 | 62 | 161 | 203 | 570 | No | No | No | | |
| 3 | 2 | 717 | 61 | 350 | 183 | 888 | No | No | No | | |
| 4 | 2 | 703 | 80 | 135 | 325 | 411 | No | No | No | | |
| 5 | 2 | 681 | 28 | 250 | 246 | 468 | Yes | No | No | | |
| 6 | 10 | 728 | 52 | 280 | 241 | 155 | Yes | Yes | No | | |
| 7 | 2 | 721 | 42 | 146 | 203 | 327 | No | No | No | | |
| 8 | 2 | 746 | 44 | 133 | 169 | 328 | No | No | Yes | 300 | 300 |
| 9 | 3 | 756 | 87 | 268 | 272 | 817 | No | No | No | | |
| 10 | 2 | 709 | 23 | 139 | 347 | 156 | No | No | No | | |
| 11 | 2 | 766 | 96 | 290 | 382 | 519 | Yes | No | No | | |
| 12 | 16 | 695 | 89 | 300 | 133 | 740 | Yes | Yes | Yes | 380 | 600 |
| 13 | 4 | 735 | 36 | 147 | 162 | 272 | No | No | Yes | 320 | 500 |
| 14 | 6 | 763 | 77 | 135 | 312 | 579 | No | No | No | | |
| 15 | 14 | 707 | 78 | 131 | 143 | 700 | Yes | Yes | Yes | 320 | 600 |
| 16 | 2 | 773 | 67 | 320 | 295 | 785 | No | No | No | | |
| 17 | 3 | 728 | 60 | 250 | 284 | 985 | No | No | No | | |
| 18 | 3 | 701 | 73 | 297 | 231 | 606 | No | No | No | | |
| 19 | 2 | 689 | 93 | 154 | 357 | 693 | No | No | No | | |
| 20 | 2 | 773 | 90 | 214 | 318 | 206 | No | No | No | | |
| 21 | 2 | 737 | 31 | 260 | 381 | 380 | No | No | No | | |
| 22 | 1 | 705 | 53 | 155 | 159 | 802 | Yes | No | No | | |
| 23 | 3 | 701 | 45 | 147 | 242 | 552 | No | No | Yes | 350 | 300 |
| 24 | 1 | 751 | 38 | 260 | 388 | 488 | No | No | No | | |
| 25 | 1 | 733 | 42 | 100 | 361 | 706 | Yes | Yes | No | | |
| 26 | 2 | 750 | 32 | 250 | 350 | 500 | No | No | No | | |
| 27 | 3 | 760 | 40 | 200 | 250 | 450 | No | No | No | | |
| 28 | 3 | 720 | 42 | 300 | 377 | 650 | No | No | No | | |
| 29 | 1 | 733 | 42 | 280 | 361 | 706 | Yes | Yes | No | | |
| 30 | 2 | 710 | 25 | **620** | 380 | 200 | No | No | No | | |
| 31 | **32** | 732 | 35 | 320 | 254 | 600 | Yes | No | No | | |
| 32 | 5 | 710 | 41 | 300 | 280 | 450 | Yes | Yes | No | | |

Bold underlines indicate outside preferable range.

The properties of the obtained steel sheet were measured and evaluated by the following methods:

[Thickness of Surface Layer Soft Part, Average Vickers Hardness (Hc) of Sheet Thickness Center Part, and Average Vickers Hardness (Hs) of Surface Layer Soft Part]

The "thickness of the surface layer soft part", the "average Vickers Hardness (Hc) of the sheet thickness center part", and the "average Vickers Hardness (Hs) of the surface layer soft part" were determined in the following way. The Vickers hardness test was performed based on JIS Z 2244-1: 2020. First, the Vickers hardness at the sheet thickness ½ position of the steel sheet was measured by a pressing load 10 g weight, next the Vickers hardnesses of a total five points were measured by a pressing load 10 g weight in the same way on a line from that position in a direction vertical to the sheet thickness and parallel to the rolling direction, and the average value of these was determined as the average Vickers hardness (Hc) of the sheet thickness center part. The distance between the measurement points was made a distance of 4 times or more the indentation. Next, GDS was used to measure the C concentration in the depth direction from the surface. The region at which the C concentration gradually increased from the surface until reaching ½ of the average C concentration of the base phase was defined as the surface layer soft part. The thickness (%) of the surface layer soft part was determined. In the thus determined surface layer soft part, the Vickers hardnesses of 10 points were randomly measured by a pressing load 10 g weight and the average value of these was calculated to thereby determine the average Vickers hardness (Hs) of the surface layer soft part.

[Internal Oxide Layer Thickness]

The thickness of the internal oxide layer was determined by obtaining a sample having a sheet thickness cross-section parallel to the rolling direction of the steel sheet and including the surface layer part of the steel sheet, examining that cross-section by an SEM, and measuring the distance from the steel sheet surface to the farthest position where the internal oxides are present in the case of advancing from the surface of the steel sheet in the thickness direction of the steel sheet (direction vertical to surface of steel sheet). The measurement depth was made the region from the surface of the steel sheet down to 50 m.

[Void Area Ratio Near Surface Layer]

The void area ratio near the surface layer was determined in the following way: First, the examined surface was polished to a mirror finish by buffing. This was used as the examined sample. Next, an SEM was used to capture an image by a magnification of 9000× centered at 5 μm below the surface of the examined sample or the interface of the plated layer and base iron. Using a 10 μm×10 μm region as one field, reflected electron topographic images of 15 adjoining consecutive fields were obtained. Regions where topographic parts were observed were analyzed by EDS, whether they were inclusions or voids was discriminated, only simple cavity parts were counted as voids, and the ratio of voids in the 10 μm×150 μm region captured by the SEM was determined as the void area ratio.

[Tensile Strength and Total Elongation]

The tensile strength TS and total elongation t-El were measured by conducting a tensile test compliant with JIS Z2241: 2011 based on a JIS No. 5 test piece taken from a direction (C direction) parallel to a width direction of the steel sheet.

[Evaluation of Bendability]

The bendability was evaluated by measuring the bending angle α (°) by a bending test based on VDA (Verband der Automobilindustrie) 238-100: 2017-04.

[Evaluation of Defect Formation]

The formation of defects was evaluated by whether length 3 μm or more microcracks were formed around the indentations when pressing down 10 locations by a Vickers hardness test machine (load 100 g weight) to a 5 μm depth position from the surface of the steel sheet at room temperature (if there is a plated layer at the surface of the steel sheet, the interface of the plated layer and the steel sheet). Specifically, cases where no microcracks were formed were evaluated as passing (OK) while cases where microcracks were formed were evaluated and failing (NG).

Cases where the tensile strength was 1250 MPa or more, the total elongation was 10% or more, the bending angle was 70° or more, and microcracks were not formed were evaluated as high strength steel sheet having improved bendability and able to suppress even formation of defects. The results are shown in Table 3. In Table 3, for steel sheets where the surface layer soft part is formed at the two sides of the sheet thickness center part, only the values relating to the surface layer soft part and internal oxide layer at one side are shown. However, each of these steel sheets is produced by performing the same treatment at its two sides, therefore the values relating to the surface layer soft parts and internal oxide layers are substantially the same at the two sides of the steel sheet. It was actually confirmed at several steel sheets that these values were the same at the two sides.

TABLE 3-1

| | | Microstructure area ratios of sheet thickness center part | | | | | | | Microstructure area ratio of surface layer soft part | | | | | | |
|---|---|---|---|---|---|---|---|---|---|---|---|---|---|---|---|
| No. | Constituent | Tempered martensite | A Ferrite | B Bainite | C Pearlite | D Retained γ | A to D total | As-quenched martensite | Ferrite | E Tempered martensite | F Bainite | G Retained γ | E to G total | Pearlite | As-quenched martensite |
| 1 | A | 87 | | 7 | | 2 | 9 | 4 | 89 | 11 | | | 11 | | |
| 2 | B | 89 | | 6 | | 1 | 7 | 4 | 89 | 11 | | | 11 | | |
| 3 | C | 86 | | 11 | | 3 | 14 | 0 | 89 | 11 | | | 11 | | |
| 4 | D | 93 | | 4 | | 3 | 7 | 0 | 90 | 10 | | | 10 | | |
| 5 | E | 87 | | 7 | | 2 | 9 | 4 | 90 | 10 | | | 10 | | |
| 6 | F | 93 | | 2 | | 1 | 3 | 4 | 89 | 11 | | | 11 | | |
| 7 | G | 89 | 1 | 6 | 1 | 3 | 11 | 0 | 87 | 13 | | | 13 | | |
| 8 | H | 89 | | 8 | | 3 | 11 | 0 | 90 | 10 | | | 10 | | |
| 9 | I | 87 | | 10 | | 2 | 12 | 1 | 88 | 12 | | | 12 | | |
| 10 | J | 86 | | 8 | | 3 | 11 | 3 | 87 | 13 | | | 13 | | |
| 11 | K | 88 | 1 | 6 | 1 | 3 | 11 | 1 | 88 | 12 | | | 12 | | |
| 12 | L | 90 | | 5 | 1 | 2 | 8 | 2 | 86 | 14 | | | 14 | | |
| 13 | M | 92 | | 5 | | 1 | 6 | 2 | 83 | 17 | | | 17 | | |
| 14 | N | 93 | | 3 | | 1 | 4 | 3 | 89 | 11 | | | 11 | | |
| 15 | O | 94 | | 4 | | 2 | 6 | 0 | 90 | 2 | 1 | 1 | 4 | | 6 |
| 16 | P | 92 | | 4 | | 2 | 6 | 2 | 88 | 7 | 2 | 1 | 10 | 2 | |
| 17 | Q | 95 | | 4 | | 1 | 5 | 0 | 89 | 11 | | | 11 | | |
| 18 | R | 90 | | 5 | | 3 | 8 | 2 | 89 | 11 | | | 11 | | |
| 19 | S | 89 | | 7 | | 1 | 8 | 3 | 86 | 14 | | | 14 | | |
| 20 | T | 90 | | 4 | | 4 | 8 | 2 | 89 | 11 | | | 11 | | |
| 21 | U | 90 | 5 | | 2 | | 7 | 3 | 85 | 15 | | | 15 | | |
| 22 | V | **82** | 6 | 4 | | | 10 | 8 | 85 | 9 | | | 9 | 6 | |

TABLE 3-1-continued

| | | Microstructure area ratios of sheet thickness center part | | | | | | | Microstructure area ratio of surface layer soft part | | | | | | |
|---|---|---|---|---|---|---|---|---|---|---|---|---|---|---|---|
| No. | Constituent | Tempered martensite | A Ferrite | B Bainite | C Pearlite | D Retained γ | A to D total | As-quenched martensite | Ferrite | E Tempered martensite | F Bainite | G Retained γ | E to G total | Pearlite | As-quenched martensite |
| 23 | W | 93 | 5 | 2 | | | 7 | | 87 | 13 | | | 13 | | |
| 24 | X | 94 | 2 | 3 | 1 | | 6 | | 87 | 9 | | | 9 | | 4 |
| 25 | Y | 95 | 3 | | 2 | | 5 | | 86 | 5 | | | 5 | 9 | |
| 26 | Z | **30** | 26 | | 0 | | 26 | 44 | 83 | 9 | | | 9 | 8 | |
| 27 | AA | 96 | 2 | 2 | | | 4 | | 92 | 6 | | | 6 | 2 | |
| 28 | AB | 91 | | 6 | | 3 | 9 | | 86 | 10 | | | 10 | 4 | |
| 29 | H | 85 | | 8 | | 4 | 12 | 3 | 85 | 10 | | | 10 | 5 | |
| 30 | H | **40** | 48 | 7 | | 5 | 60 | | 88 | 5 | | | 5 | 7 | |
| 31 | H | 87 | 4 | 7 | 2 | | 13 | | **55** | 8 | | | 8 | 2 | 35 |
| 32 | H | 95 | | 5 | | | 5 | | 92 | 4 | | | 4 | 4 | |

Bold underlines indicate outside preferable range.

TABLE 3-2

| No. | Constituent | Sheet thickness (mm) | Internal oxide layer thickness (μm) | Position of surface layer soft part | Surface layer soft part thickness of one side/sheet thickness (%) | Hc Average Vickers hardness of sheet thickness center part (Hv) | Hs Average Vickers hardness of surface layer soft part (Hv) | Hs/Hc | Void area ratio near surface layer (%) | Tensile strength TS (MPa) | Total elongation t-El (%) | Bending angle α (°) | Microcracks | Remarks |
|---|---|---|---|---|---|---|---|---|---|---|---|---|---|---|
| 1 | A | 1.3 | 5 | Two sides | 2.4 | 466 | 219 | 0.47 | 0.0 | 1495 | 13 | 91 | OK | Example |
| 2 | B | 1.8 | 12 | Two sides | 2.1 | 479 | 211 | 0.44 | 0.8 | 1539 | 11 | 77 | OK | Example |
| 3 | C | 2.2 | 5 | Two sides | 1.6 | 429 | 206 | 0.48 | 0.0 | 1417 | 14 | 99 | OK | Example |
| 4 | D | 2.5 | 19 | Two sides | 1.7 | 437 | 205 | 0.47 | 0.0 | 1400 | 14 | 83 | OK | Example |
| 5 | E | 1.4 | 12 | Two sides | 2.9 | 490 | 230 | 0.47 | 0.0 | 1578 | 12 | 84 | OK | Example |
| 6 | F | 2.0 | 9 | Two sides | 1.9 | 453 | 208 | 0.46 | 0.0 | 1474 | 13 | 85 | OK | Example |
| 7 | G | 2.0 | 7 | Two sides | 2.0 | 407 | 199 | 0.49 | 0.0 | 1289 | 12 | 80 | OK | Example |
| 8 | H | 1.7 | 6 | Two sides | 1.9 | 439 | 211 | 0.48 | 0.0 | 1418 | 13 | 76 | OK | Example |
| 9 | I | 2.2 | 8 | Two sides | 1.7 | 536 | 257 | 0.48 | 0.0 | 1729 | 14 | 94 | OK | Example |
| 10 | J | 1.9 | 8 | Two sides | 2.1 | 458 | 206 | 0.45 | 0.0 | 1501 | 13 | 72 | OK | Example |
| 11 | K | 1.3 | 14 | One side | 4.8 | 430 | 211 | 0.49 | 0.0 | 1369 | 13 | 78 | OK | Example |
| 12 | L | 2.2 | 10 | Two sides | 1.8 | 448 | 215 | 0.48 | 0.6 | 1419 | 13 | 78 | OK | Example |
| 13 | M | 2.2 | 6 | Two sides | 1.4 | 472 | 203 | 0.43 | 0.0 | 1498 | 12 | 80 | OK | Example |
| 14 | N | 1.7 | 6 | Two sides | 1.8 | 478 | 220 | 0.46 | 0.0 | 1511 | 12 | 74 | OK | Example |
| 15 | O | 2.1 | 5 | Two sides | 1.5 | 408 | 200 | 0.49 | 0.0 | 1298 | 12 | 98 | OK | Example |
| 16 | P | 2.1 | 11 | Two sides | 2.0 | 461 | 212 | 0.46 | 0.0 | 1499 | 15 | 72 | OK | Example |
| 17 | Q | 2.2 | 10 | One side | 1.8 | 473 | 199 | 0.42 | 0.0 | 1510 | 12 | 83 | OK | Example |
| 18 | R | 2.2 | 8 | Two sides | 2.0 | 492 | 231 | 0.47 | 0.0 | 1598 | 14 | 90 | OK | Example |
| 19 | S | 2.2 | 3 | Two sides | 1.8 | 432 | 199 | 0.46 | 0.0 | 1409 | 11 | 86 | OK | Example |
| 20 | T | 1.8 | 6 | Two sides | 1.9 | 435 | 209 | 0.48 | 0.0 | 1404 | 12 | 96 | OK | Example |
| 21 | U | 1.4 | 9 | Two sides | 2.8 | 457 | 215 | 0.47 | 0.0 | 1446 | 13 | 77 | OK | Example |
| 22 | V | 2.3 | 10 | Two sides | 1.7 | 270 | 175 | **0.65** | 0.0 | 868 | 15 | 85 | OK | Comp. ex. |
| 23 | W | 1.7 | 11 | Two sides | 2.6 | 584 | 286 | 0.49 | 0.0 | 1886 | 4 | 65 | OK | Comp. ex. |
| 24 | X | 1.5 | 14 | Two sides | 2.7 | 467 | 215 | 0.46 | 0.0 | 1521 | 8 | 68 | OK | Comp. ex. |
| 25 | Y | 1.7 | 20 | Two sides | 2.5 | 511 | 220 | 0.43 | 0.0 | 1601 | 7 | 73 | OK | Comp. ex. |
| 26 | Z | 1.6 | 11 | Two sides | 2.2 | 420 | 197 | 0.47 | 0.0 | 1378 | 4 | 60 | OK | Comp. ex. |
| 27 | AA | 1.2 | 9 | Two sides | 3.0 | 502 | 236 | 0.47 | 0.0 | 1568 | 5 | 83 | OK | Comp. ex. |
| 28 | AB | 2.2 | **1** | Two sides | 1.4 | 445 | 200 | 0.45 | 0.0 | 1470 | 12 | 85 | NG | Comp. ex. |
| 29 | H | 1.6 | 7 | Two sides | 2.0 | 454 | 222 | 0.49 | **5.0** | 1478 | 13 | 88 | NG | Comp. ex. |
| 30 | H | 1.6 | 8 | Two sides | 2.2 | 296 | 193 | **0.65** | 0.0 | 955 | 4 | 86 | OK | Comp. ex. |
| 31 | H | 1.8 | 8 | Two sides | 2.0 | 434 | 290 | **0.67** | 0.0 | 1397 | 12 | 60 | OK | Comp. ex. |
| 32 | H | 1.2 | **2** | Two sides | 3.1 | 434 | 213 | 0.49 | 0.0 | 1397 | 13 | 76 | NG | Comp. ex. |

Bold underlines indicate outside preferable range.

Referring to Table 3, in Comparative Example 22, the total area ratio of the tempered martensite and as-quenched martensite was relatively high, but the C content was low, therefore the tensile strength fell. In Comparative Example 23, the C content was high, therefore the tensile strength rose, but the bendability fell. In Comparative Example 24, the Si content was high, therefore the bendability fell. In Comparative Example 25, the Mn content was high, therefore the bendability fell. In Comparative Example 26, the Al content was high, therefore it is believed coarse Al oxides were formed and, as a result, the bendability fell. In Comparative Example 27, the Cr content was high, therefore it is believed coarse Cr carbides were formed and, as a result, the bendability fell. In Comparative Example 28, the total content of Si, Mn, Al, and Cr was low, therefore an internal oxide layer could not be sufficiently formed and, as a result, the surface hardness fell and formation of microcracks was observed. In Comparative Example 29, the coiling temperature was high, therefore at the time of the hot rolling step, an internal oxide layer ended up being formed. For this reason, it is believed that at the time of cold rolling, voids were formed around the internal oxides and, as a result, in the final product steel sheet, the area ratio of voids near the surface layer could not be sufficiently reduced and formation of microcracks was observed. In Comparative Example 30, the stop temperature of the secondary cooling was high, therefore at the sheet thickness center part, the desired amount of tempered martensite was not formed and as a result the tensile strength fell. In Comparative Example 31, the average cooling rate of the primary cooling was fast, therefore it was not possible to sufficient form ferrite at the surface layer soft part and, as a result, the value of Hs/Hc became high and the bendability fell. In Comparative Example 32, the log $P_{O2}$ of the oxygen partial pressure $P_{O2}$ in the annealing step was low, therefore decarburization was not promoted and an internal oxide layer could not be sufficiently formed. As a result, the surface hardness fell and formation of microcracks was observed.

In contrast to this, in each of Examples 1 to 21, by controlling the sheet thickness center part and surface layer soft part having the predetermined chemical composition and/or microstructure so that their average Vickers hardnesses satisfied Hs/Hc≤0.50 and, further, by making the internal oxide layer a thickness of 3 μm or more from the steel sheet surface while controlling the void area ratio near the surface layer to 3.0% or less, it was possible to improve the bendability regardless of having a 1250 MPa or more high strength and, further, possible to remarkably suppress the formation of defects at the steel sheet surface.

Examples B

In each of these examples, the effect of control of the heat history after coiling on the properties of the obtained steel sheet was investigated. Specifically, using Example 16 of Table 3 as a reference (maximum temperature of the hot rolled coil after coiling: 567° C. and holding time at temperature region from the maximum temperature down to 500° C.: 3.5 hours), in each of Comparative Examples 33 and 34, the maximum temperature of the hot rolled coil after coiling and the holding time at the temperature region from the maximum temperature down to 500° C. were changed. The other production conditions in Comparative Examples 33 and 34 were the same as Example 16. The results are shown in Table 4.

TABLE 4

| No. | Constituent | Maximum temp. after coiling (° C.) | Holding time from maximum temp. to 500° C. (h) | Void area ratio near surface layer (%) | Micro-cracks | Remarks |
|---|---|---|---|---|---|---|
| 16 | P | 567 | 3.5 | 0.0 | OK | Ex |
| 33 | P | **643** | 3 | **3.9** | NG | Comp. ex. |
| 34 | P | 567 | **5.3** | **4.6** | NG | Comp. ex. |

Bold underlines indicate outside preferred range or outside scope of present invention.

Referring to Table 4, in Example 16 in which the maximum temperature of the hot rolled coil after coiling was 580° C. or less and the holding time in the temperature region from that maximum temperature to 500° C. was 4 hours or less, as already shown in Table 3 as well, the void area ratio near the surface layer at the final product steel sheet was 0.0% and therefore the ratio could be sufficiently decreased to 3.0% or less. As a result, in Example 16, formation of microcracks was not observed. On the other hand, in Comparative Example 33 in which the maximum temperature of the hot rolled coil after coiling was more than 580° C. and in Comparative Example 34 in which the holding time in the temperature region from the maximum temperature down to 500° C. was more than 4 hours, the void area ratio near the surface layer could not be controlled to 3.0% or less and formation of microcracks was observed. This result is believed to be due to the maximum temperature of the hot rolled coil after coiling being high or the holding time being long, therefore an internal oxide layer ending up being formed at the time of the hot rolling step and voids being formed around the internal oxides at the time of the subsequent cold rolling.

The invention claimed is:

1. A high strength steel sheet comprising a sheet thickness center part and a surface layer soft part formed at one side or both sides of the sheet thickness center part, wherein the sheet thickness center part has a chemical composition comprising, by mass %, C: 0.10 to 0.30%,
Si: 0.01 to 2.50%,
Mn: 0.10 to 10.00%,
P: 0.100% or less,
S: 0.0500% or less,
Al: 0 to 1.50%,
N: 0.0100% or less,
O: 0.0060% or less,
Cr: 0 to 2.00%,
Mo: 0 to 1.00%,
B: 0 to 0.0100%,
Ti: 0 to 0.30%,
Nb: 0 to 0.30%,
V: 0 to 0.50%,
Cu: 0 to 1.00%,
Ni: 0 to 1.00%,
Ca: 0 to 0.040%,
Mg: 0 to 0.040%,
REM: 0 to 0.040%, and a remainder comprising Fe and impurities, and satisfying 1.50≤[Si]+[Mn]+[Al]+[Cr]≤20.00, wherein [Si], [Mn], [Al], and [Cr] are contents (mass %) of the elements, and has a microstructure comprising, by area ratio, tempered martensite: 85% or more, the surface layer soft part has a thickness of more than 10 μm to 5.0% or less of the sheet thickness, wherein the sheet thickness is 0.6 mm or more, a microstructure comprising, by area ratio, ferrite: 80% or more, and an internal oxide layer having a thickness of 3 μm or more from the surface of the high strength steel sheet, an average Vickers hardness (Hc) of the sheet thickness center part and an average Vickers hardness (Hs) of the surface layer soft part satisfy Hs/Hc≤0.50, and a void area ratio in a region from the surface of the high strength steel sheet down to a 10 μm depth position is 3.0% or less.

2. The high strength steel sheet according to claim 1, wherein the sheet thickness center part has a microstructure comprising, by area ratio, tempered martensite: 85% or more, at least one of ferrite, bainite, pearlite, and retained austenite: less than 15% in total, and as-quenched martensite: less than 5%.

3. The high strength steel sheet according to claim 1, wherein the surface layer soft part has a microstructure comprising, by area ratio, ferrite: 80% or more, at least one of tempered martensite, bainite, and retained austenite: less than 20% in total, pearlite: less than 5%, and as-quenched martensite: less than 5%.

4. The high strength steel sheet according to claim 1, wherein the high strength steel sheet further comprises a hot dip galvanized layer, hot dip galvannealed layer, or electrogalvanized layer on the surface of the surface layer soft part.

* * * * *